US011274895B2

(12) United States Patent
Niswander et al.

(10) Patent No.: US 11,274,895 B2
(45) Date of Patent: Mar. 15, 2022

(54) SYSTEM AND METHOD FOR A LINEAR TRIGGER ASSEMBLY

(71) Applicant: AGENCY ARMS, LLC, Ventura, CA (US)

(72) Inventors: Randy Paul Niswander, Oxnard, CA (US); Michael Lee Parks, Canyon Country, CA (US)

(73) Assignee: AGENCY ARMS, LLC, Ventura, CA (US)

( * ) Notice: Subject to any disclaimer, the term of this patent is extended or adjusted under 35 U.S.C. 154(b) by 115 days.

(21) Appl. No.: 16/878,768

(22) Filed: May 20, 2020

(65) Prior Publication Data

US 2020/0386502 A1 Dec. 10, 2020

Related U.S. Application Data

(60) Provisional application No. 62/858,188, filed on Jun. 6, 2019.

(51) Int. Cl.
*F41A 19/10* (2006.01)

(52) U.S. Cl.
CPC ..... *F41A 19/10* (2013.01)

(58) Field of Classification Search
CPC ..... F41A 19/10; F41A 19/16
See application file for complete search history.

(56) References Cited

U.S. PATENT DOCUMENTS

| | | | | |
|---|---|---|---|---|
| 4,449,313 | A * | 5/1984 | Hackett | F41A 19/10 42/69.01 |
| 4,575,963 | A * | 3/1986 | Ruger | F41A 17/72 42/70.08 |
| 4,577,430 | A * | 3/1986 | Ruger | F41A 19/10 42/69.01 |
| 4,667,429 | A * | 5/1987 | Perazzi | F41A 19/16 42/69.01 |
| 7,156,662 | B2 * | 1/2007 | Goko | F41A 19/16 434/21 |
| 7,392,611 | B2 * | 7/2008 | Curry | F41A 11/00 42/106 |
| 8,505,225 | B1 * | 8/2013 | Degener | F41A 19/10 42/69.01 |
| 9,052,149 | B2 * | 6/2015 | Bender | F41A 19/00 |
| 9,267,750 | B1 * | 2/2016 | Tubb | F41A 19/12 |
| 9,885,532 | B1 * | 2/2018 | Morgan | F41A 19/10 |
| 10,578,385 | B2 * | 3/2020 | Dextraze | F41A 19/16 |
| 10,605,554 | B2 * | 3/2020 | Marin | F41A 19/10 |
| 10,809,031 | B2 * | 10/2020 | Geissele | F41A 19/15 |
| 11,054,204 | B2 * | 7/2021 | Curry | F41A 19/12 |

FOREIGN PATENT DOCUMENTS

| | | | | |
|---|---|---|---|---|
| WO | WO-2015106759 A1 * | 7/2015 | | F41A 19/12 |

* cited by examiner

*Primary Examiner* — Joshua T Semick
(74) *Attorney, Agent, or Firm* — Eversheds Sutherland (US) LLP

(57) ABSTRACT

A trigger assembly is disclosed. The trigger assembly includes a trigger shoe having a top surface, a brace coupled to the trigger shoe, a joint coupled to the brace, a trigger bar coupled to the brace, a trigger hood coupled to the top surface of the trigger shoe and the joint, and a track disposed between the trigger hood and the trigger shoe, wherein the trigger shoe is configured to move along the track.

18 Claims, 30 Drawing Sheets

SYSTEM AND METHOD FOR A LINEAR TRIGGER ASSEMBLY

CROSS-REFERENCE TO RELATED APPLICATIONS

The present disclosure claims priority to and the benefit of U.S. application Ser. No. 62/858,188, filed Jun. 6, 2019, which is hereby incorporated by reference herein in its entirety.

FIELD

The present disclosure is generally directed to a trigger assembly for a firearm and, more particularly, to a trigger assembly that actuates along a parallel or substantially parallel axis to the barrel of the firearm.

BACKGROUND

Firearm triggers cause one or more mechanisms within a firearm to ignite the primer and discharge a projectile. However, some triggers are more complicated than others. Depending on the firearm, triggers can be optimized for trigger weight, safety modifications, and trigger shoe shape, among other characteristics. Each of these characteristics may be difficult to customize on certain firearms due to size constraints within the receiver, other components within the firearm, and/or a reduction in overall firearm safety.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical, elements throughout.

Figure 1A:
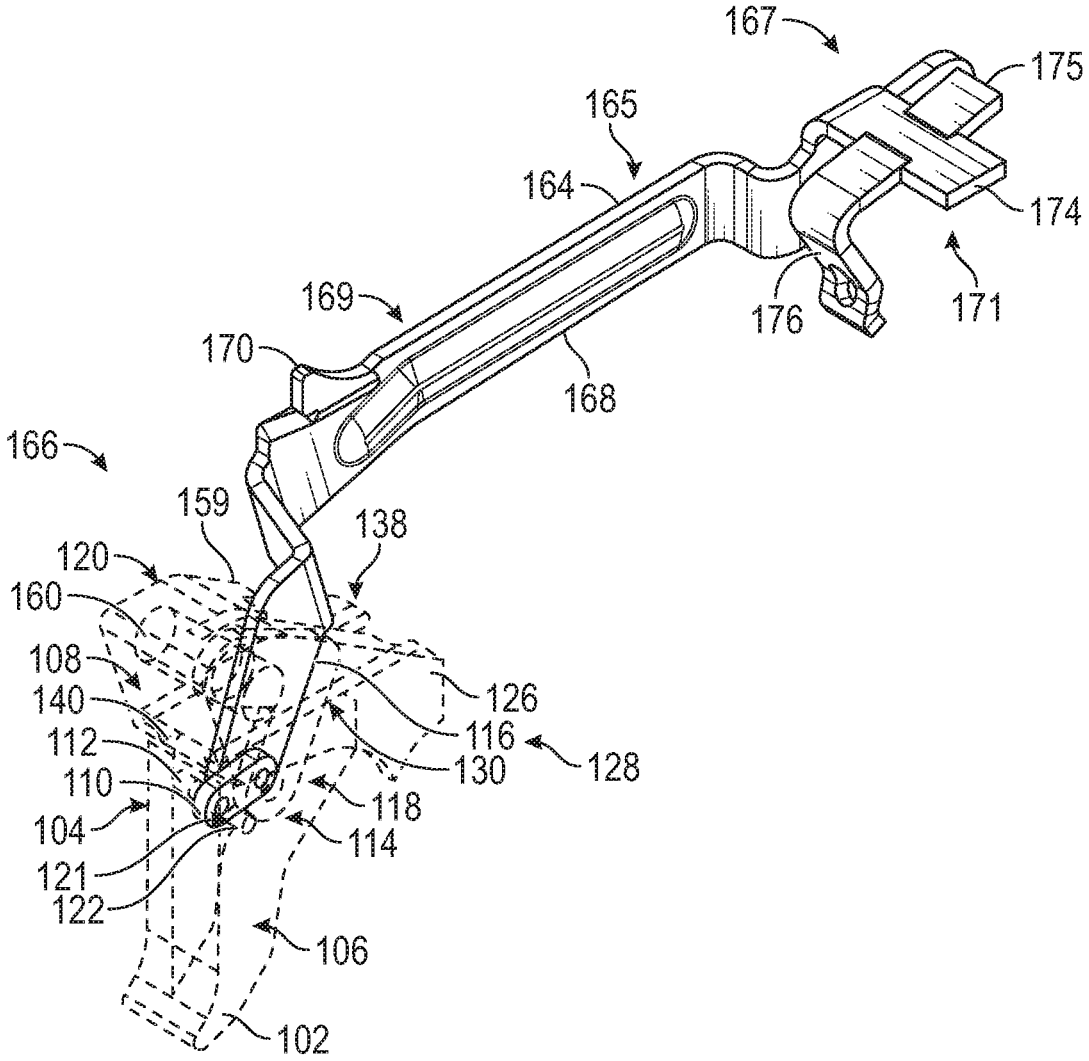
FIG. 1A is a partial-translucent perspective view of a trigger assembly in accordance with one example embodiment of the disclosure.
Figure 1B:
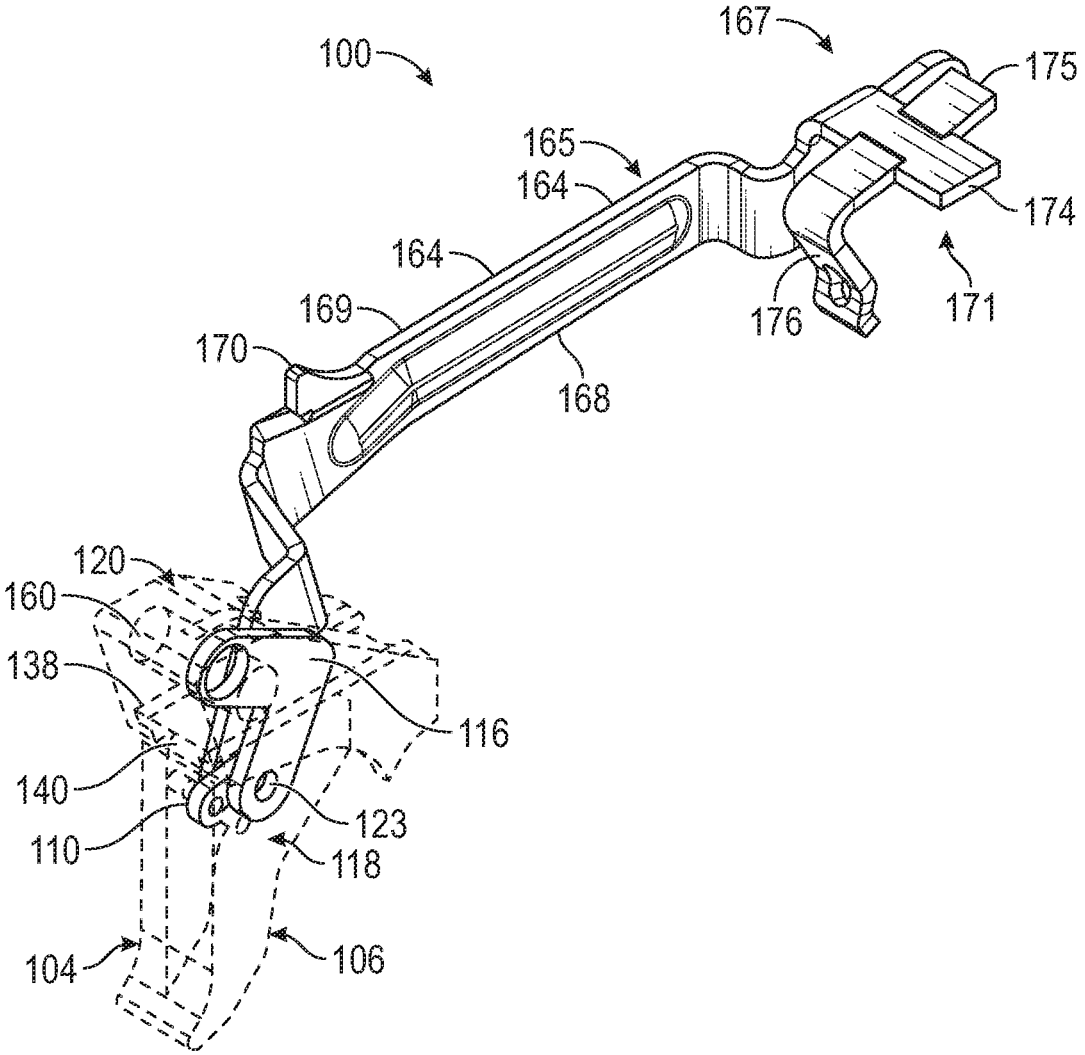
FIG. 1B is a partial-translucent perspective view of the trigger assembly of FIG. 1A in accordance with one example embodiment of the disclosure.
Figure 1C:
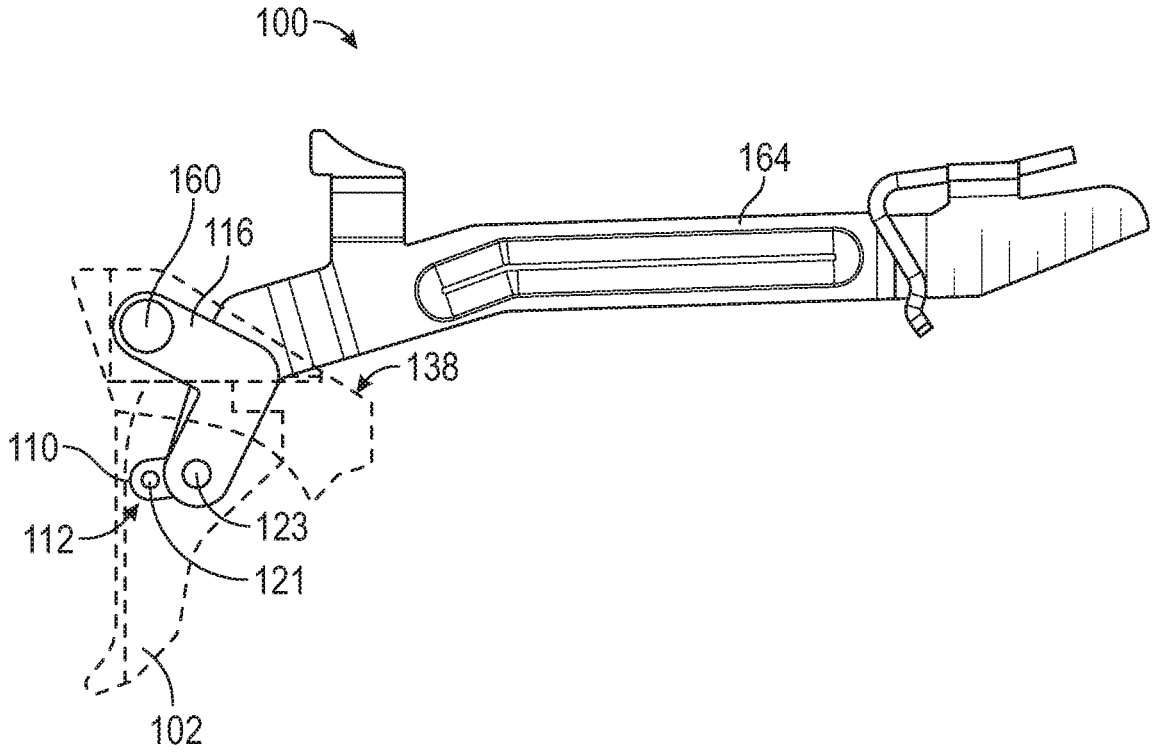
FIG. 1C is a partial-translucent side elevation view of the trigger assembly of FIG. 1A in accordance with one example embodiment of the disclosure.
Figure 1D:
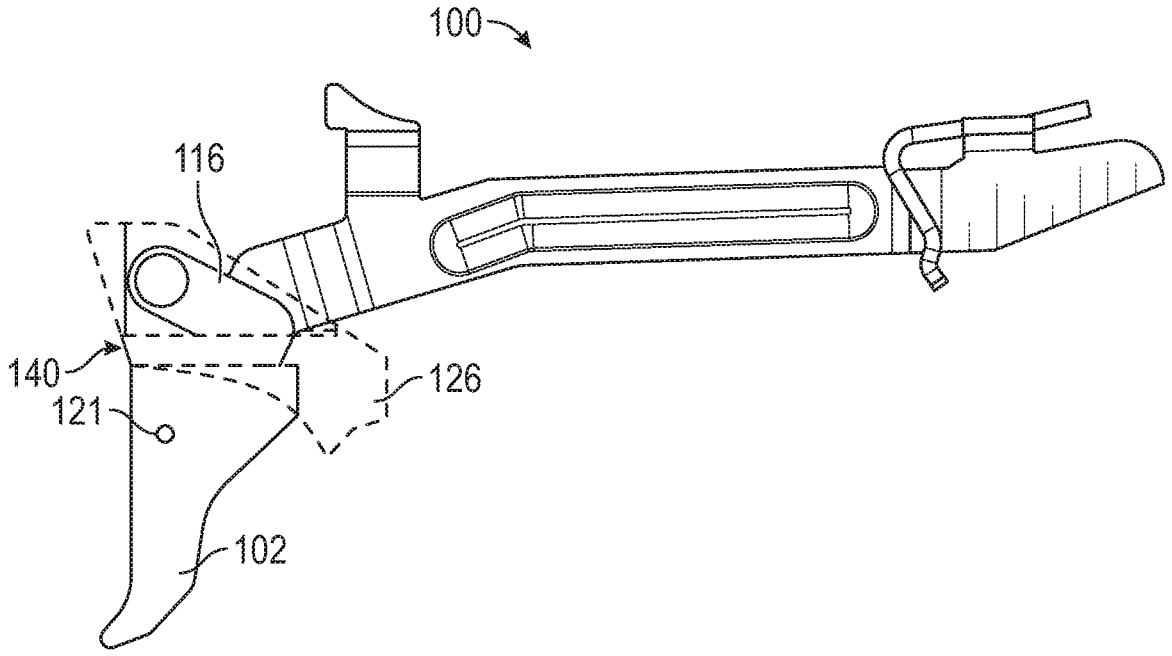
FIG. 1D is a partial-translucent side elevation view of the trigger assembly of FIG. 1A in accordance with one example embodiment of the disclosure.
Figure 1E:
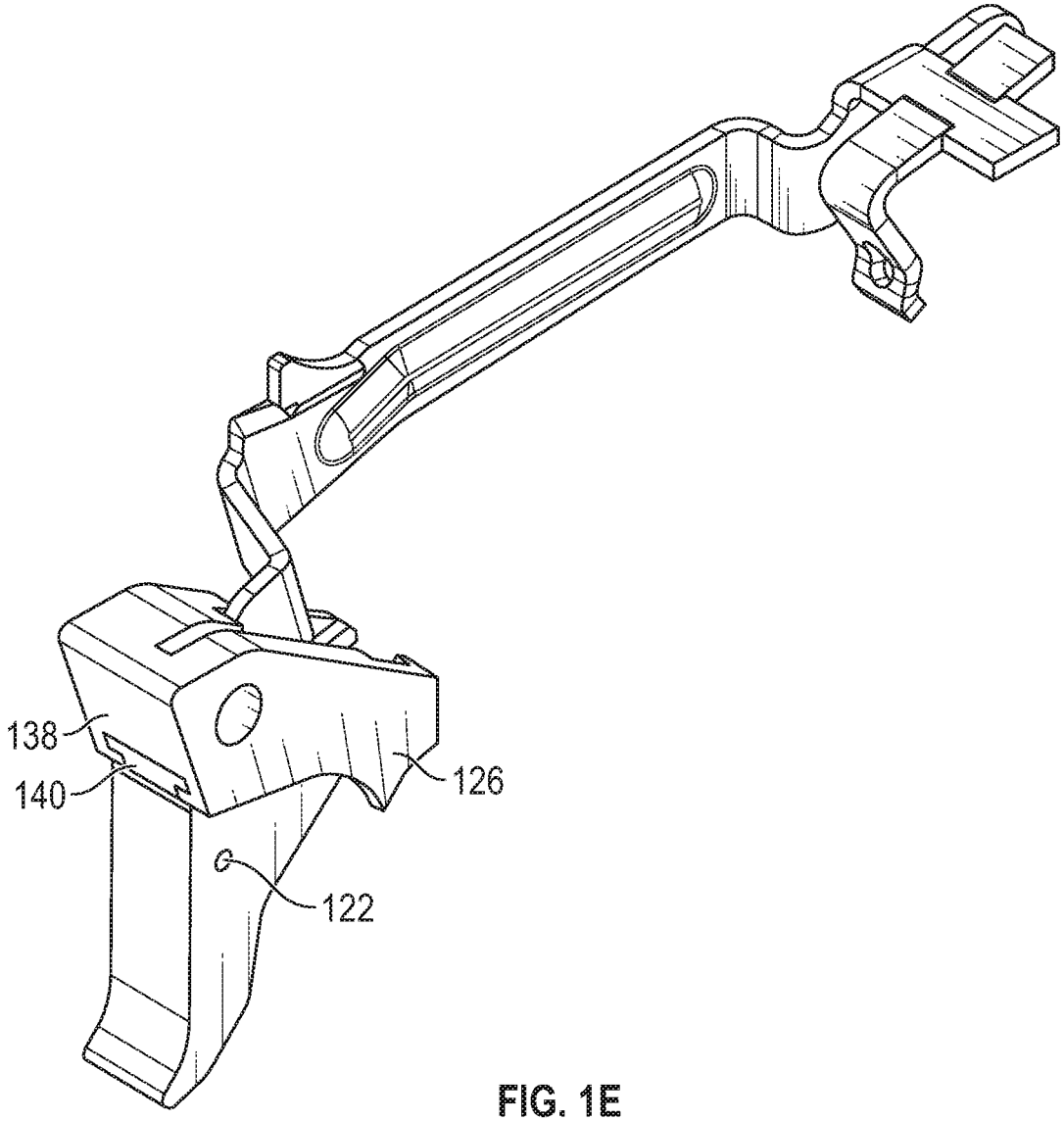
FIG. 1E is a perspective view of the trigger assembly of FIG. 1A in accordance with one example embodiment of the disclosure.
Figure 1F:
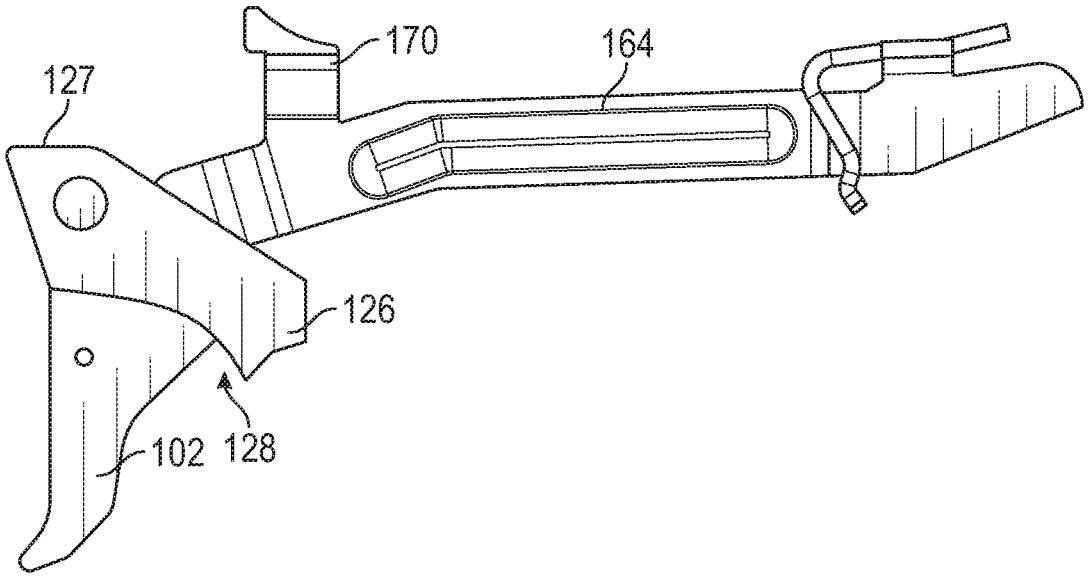
FIG. 1F is a side elevation view of the trigger assembly of FIG. 1A in accordance with one example embodiment of the disclosure.
Figure 2:
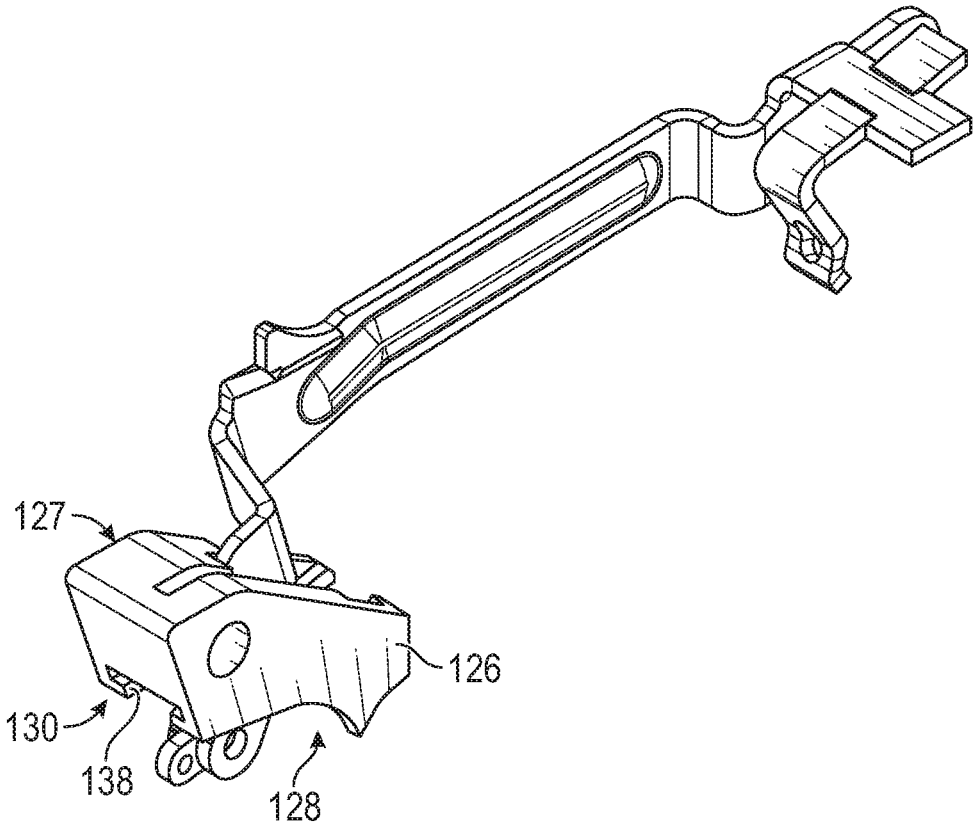
FIG. 2 is a perspective view of a trigger bar, a trigger hood, a joint, and a brace of the trigger assembly of FIG. 1A in accordance with one example embodiment of the disclosure.
Figure 3A:
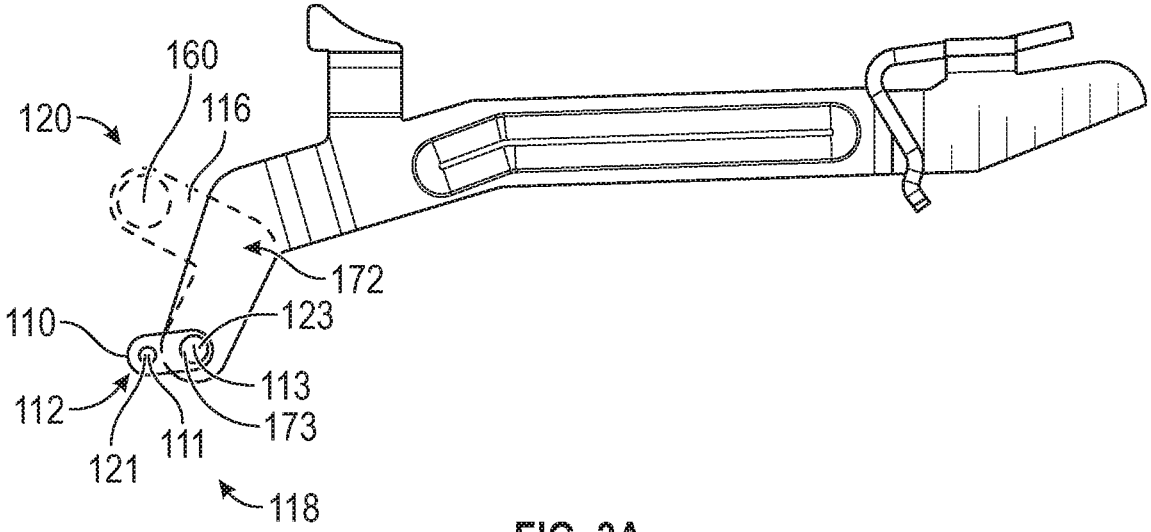
FIG. 3A is a partial-translucent side elevation view of the trigger bar, the joint, and the brace of the trigger assembly of FIG. 1A in accordance with one example embodiment of the disclosure.
Figure 3B:
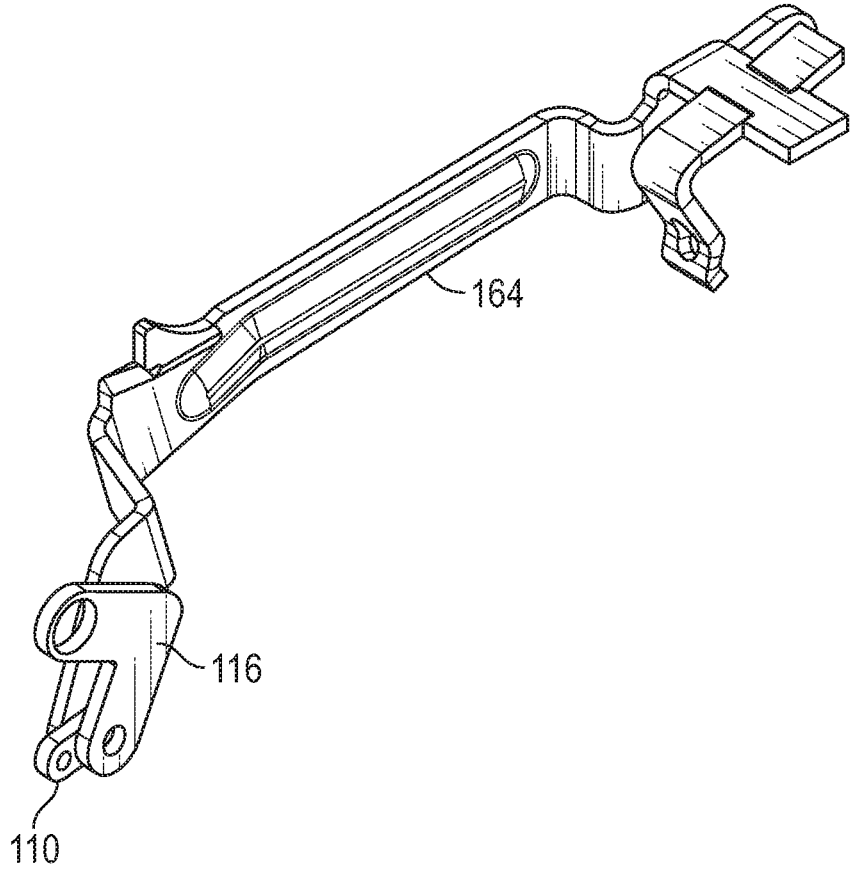
FIG. 3B is a perspective view of the trigger bar, the joint, and the brace of the trigger assembly of FIG. 1A in accordance with one example embodiment of the disclosure.
Figure 3C:
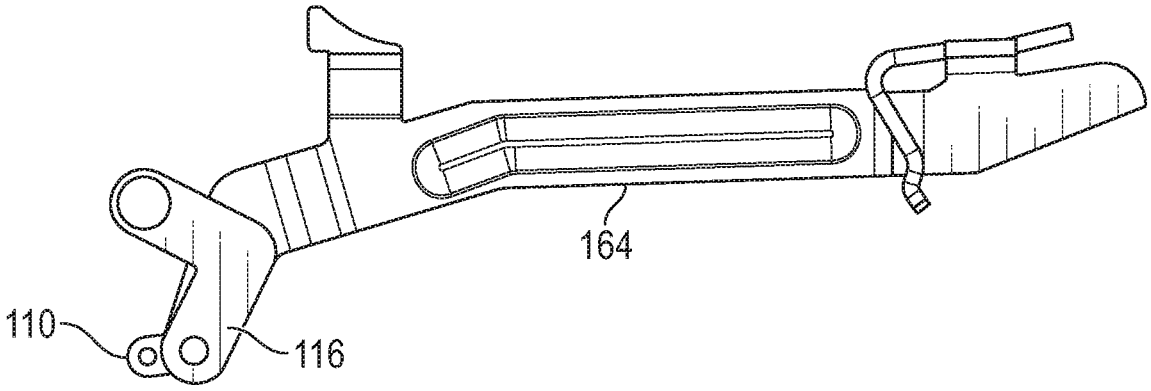
FIG. 3C is a side elevation view of the trigger bar, the joint, and the brace of the trigger assembly of FIG. 1A in accordance with one example embodiment of the disclosure.
Figure 4A:
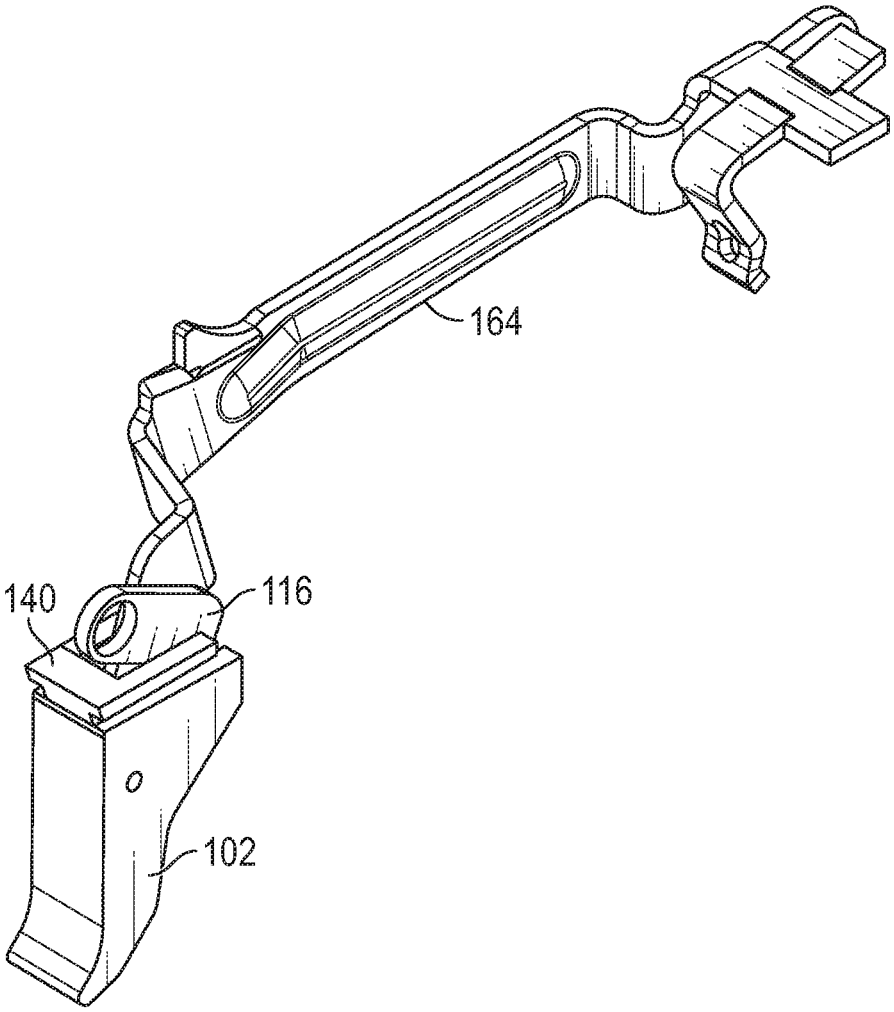
FIG. 4A is a perspective view of a trigger shoe, the trigger bar, and the joint of FIG. 1A in accordance with one example embodiment of the disclosure.
Figure 4B:
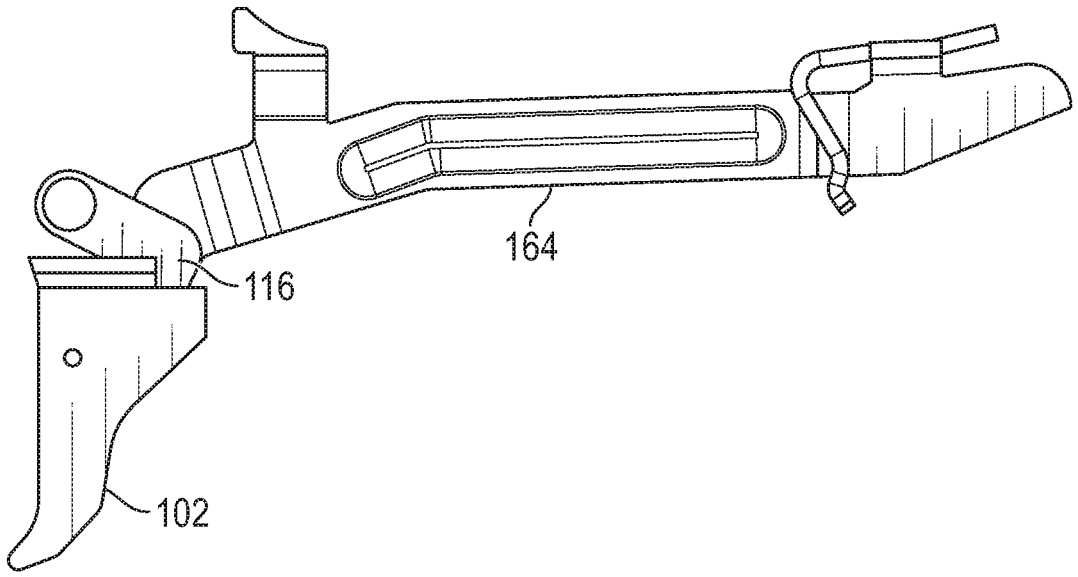
FIG. 4B is a side elevation view of the trigger shoe, the trigger bar, and the joint of FIG. 1A in accordance with one example embodiment of the disclosure.
Figure 5A:
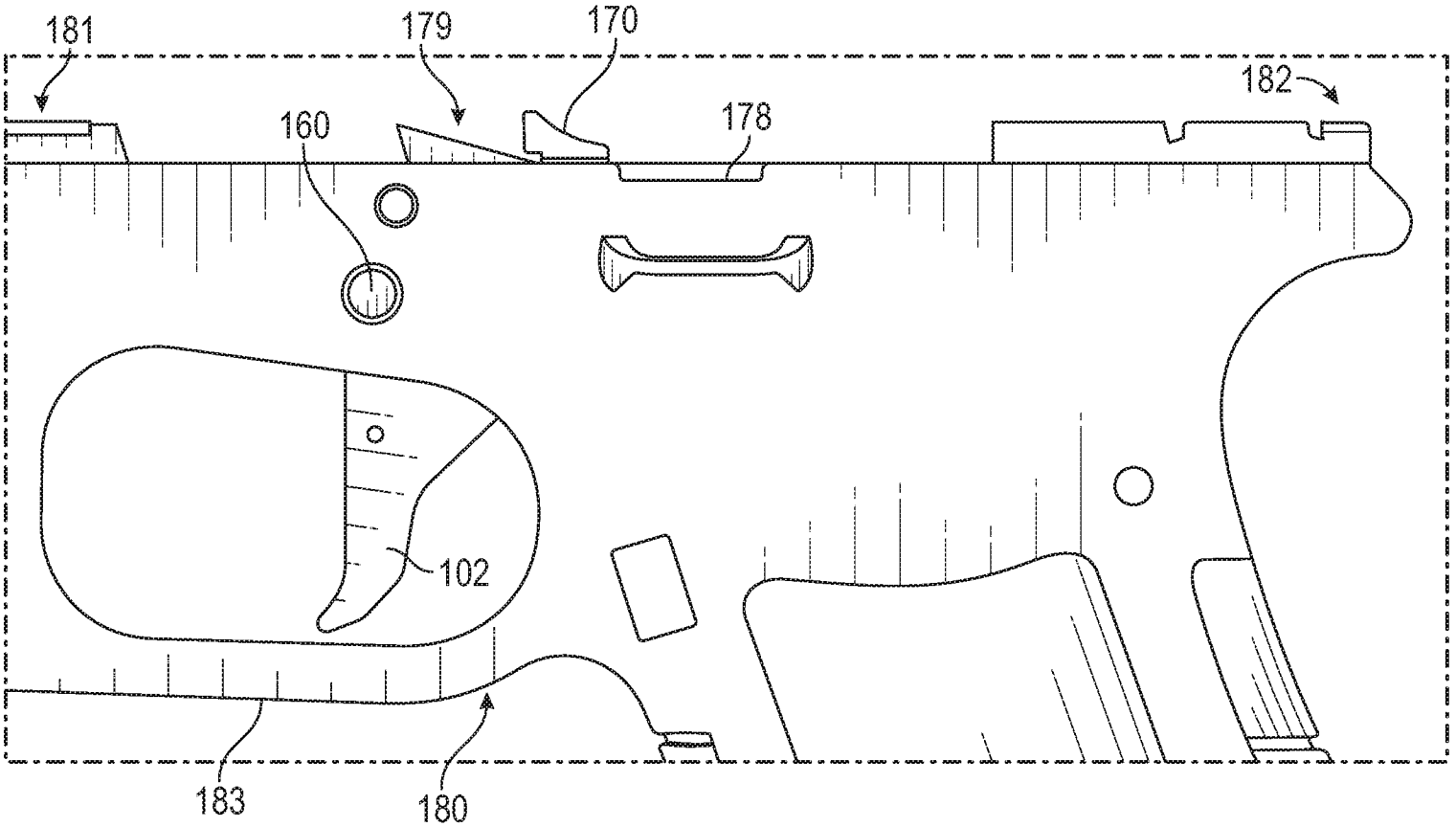
FIG. 5A is a partial side elevation view of the trigger assembly of FIG. 1A incorporated into a firearm in accordance with one example embodiment of the disclosure.
Figure 5B:
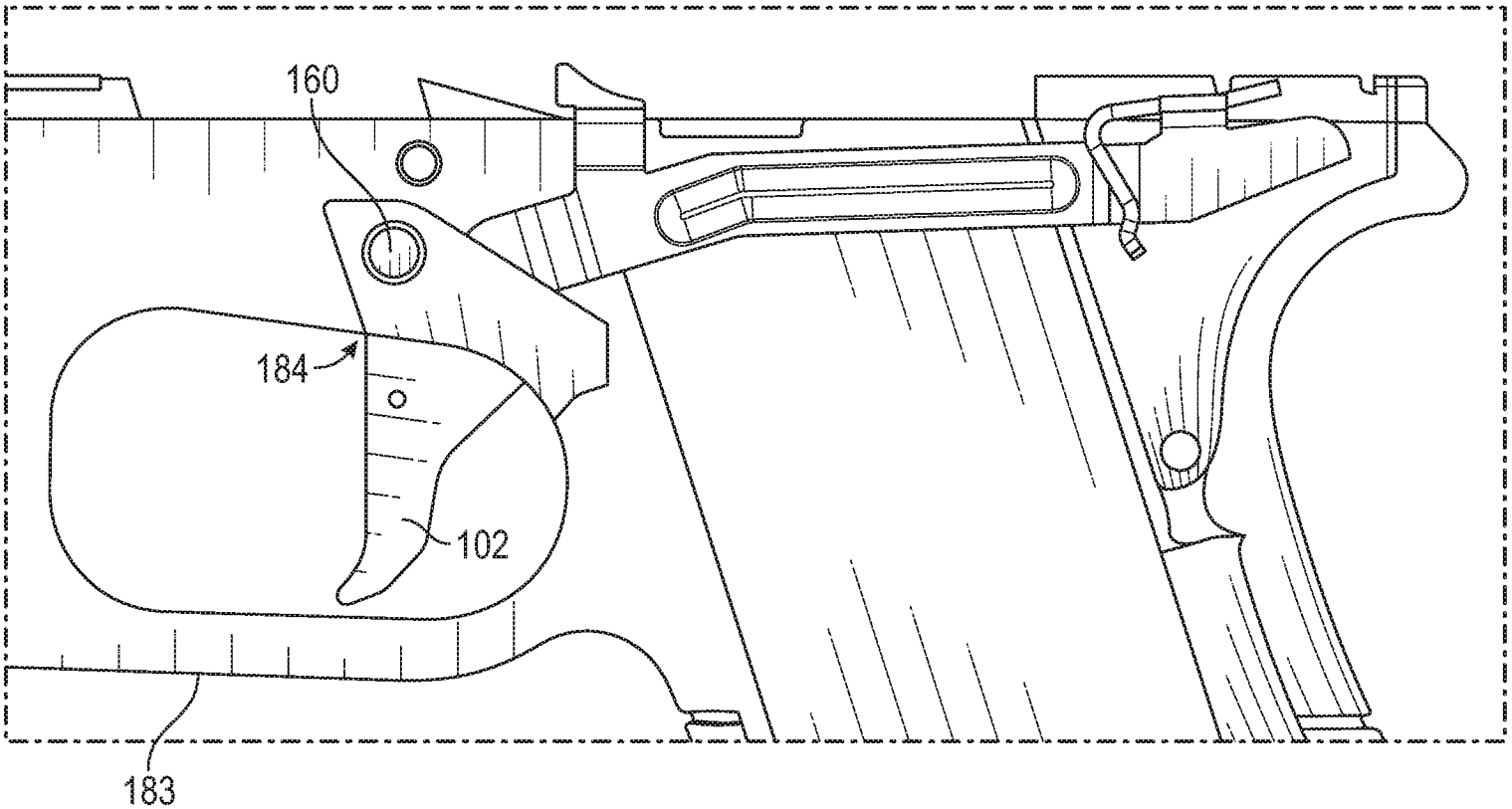
FIG. 5B is a partial-translucent side elevation view of the trigger assembly of FIG. 1A incorporated into the firearm in accordance with one example embodiment of the disclosure.

FIGS. 1A-1F depict various views of a trigger assembly 100 in accordance with one example embodiment of the disclosure. FIGS. 2-4B depict various views of certain components of the trigger assembly 100 of FIG. 1A in accordance with one example embodiment of the disclosure. FIGS. 5A-5B depict partial side elevation views of trigger assembly 100 incorporated into a firearm in accordance with one example embodiment of the disclosure. Referring now to FIGS. 1A-5B, the trigger assembly 100 can include a trigger shoe 102, a brace 110, a joint 116, a trigger hood 126, and a trigger bar 164 coupled together to discharge a firearm. In some examples, the trigger shoe 102 includes a trigger shoe aperture 121 extending through the trigger shoe 102, and the brace 110 includes a first brace end aperture 111 extending through a first brace end 112 of the brace 110. The trigger shoe 102 and the brace 110 are coupled together by a trigger shoe pin 122 (e.g., as shown in FIG. 1E) that extends through both the trigger shoe pin aperture 121 and the first brace end aperture 111. In this manner, as the trigger shoe 102 moves, the brace 110 moves in the same direction as the trigger shoe 102. The brace 110 can also include a second brace end 114 and a second brace end aperture 123 positioned along the second brace end 114 that extends through the brace 110. The second brace end aperture 113 aligns with apertures on the joint 116 and the leg aperture 173. In this manner, any movement of the trigger shoe 102 translates from the trigger shoe 102, through the brace 110, and onto the joint 116 and the trigger bar 164. For example, as shown in FIG. 1A, the trigger shoe 102 is guided along a bottom surface 128 of the trigger hood 126. As the trigger shoe 102 moves along the bottom surface 128 of the trigger hood 126, the other components (e.g., the brace 110, the joint 116, etc.) move simultaneously with the trigger shoe 102.

Referring now to FIG. 1A, the trigger shoe 102 can include a first surface 104, a second surface 106, and a top surface 108. In some examples, the first surface 104 is substantially flat. In other examples, the first surface 104 can be another shape, such as arcuate. The second surface 106 can be angled or curvilinear and can extend towards the first surface 104, thereby meeting the first surface 104 at a point. The trigger shoe 102 can also include a trigger shoe aperture 121 that is disposed between the first surface 104 and the second surface 106 extending generally perpendicular to the first surface 104. The trigger shoe aperture 121 may extend in a variety of other directions within the trigger shoe 102. In one example, the trigger shoe aperture 121 can complement the shape of the trigger shoe pin 122 by which the trigger shoe aperture 121 receives the trigger shoe pin 122.

Figure 6A:
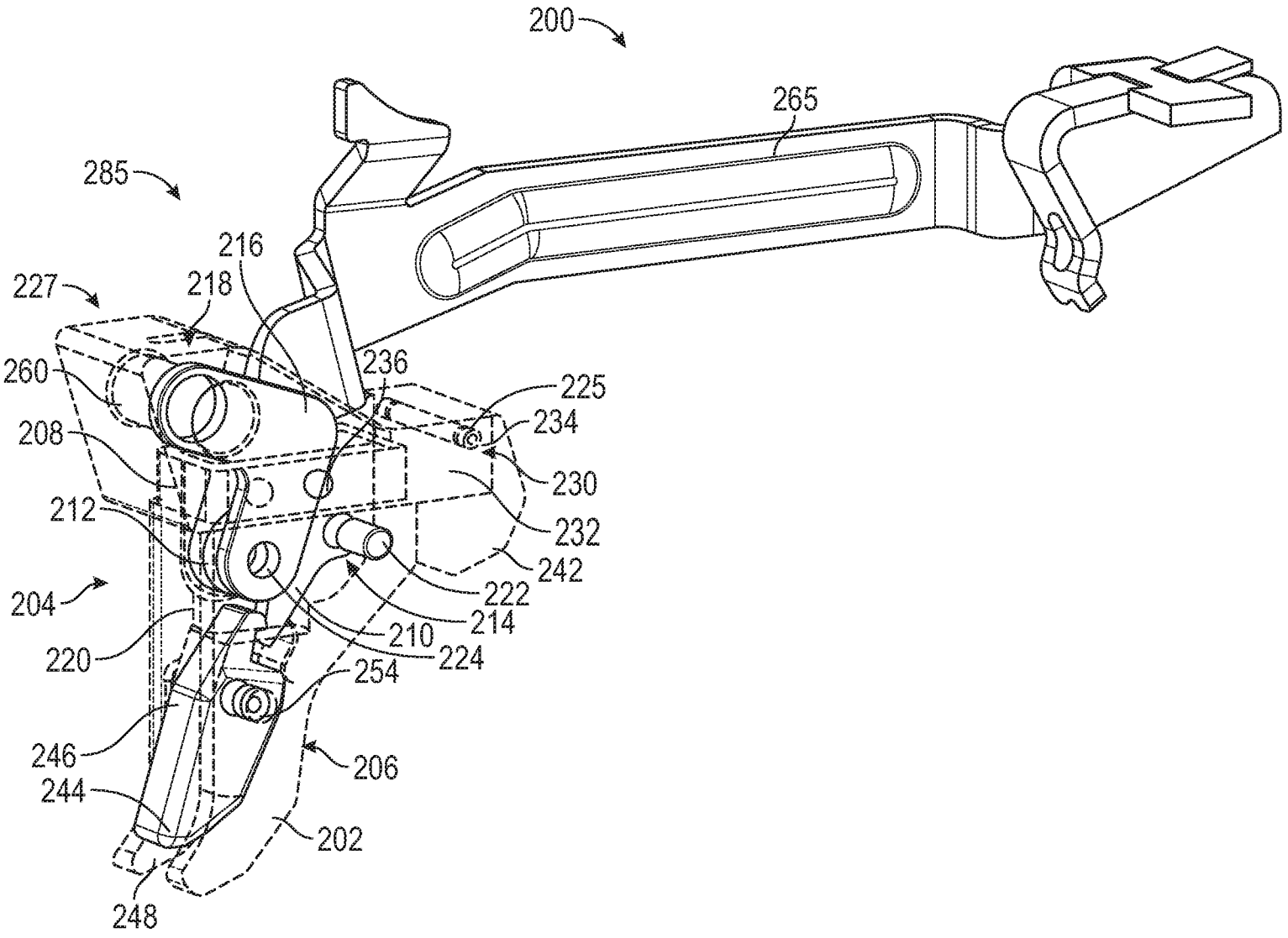
FIG. 6A is a partial-translucent and partial-exploded view of a trigger assembly in a safety position in accordance with another example embodiment of the disclosure.
Figure 6B:
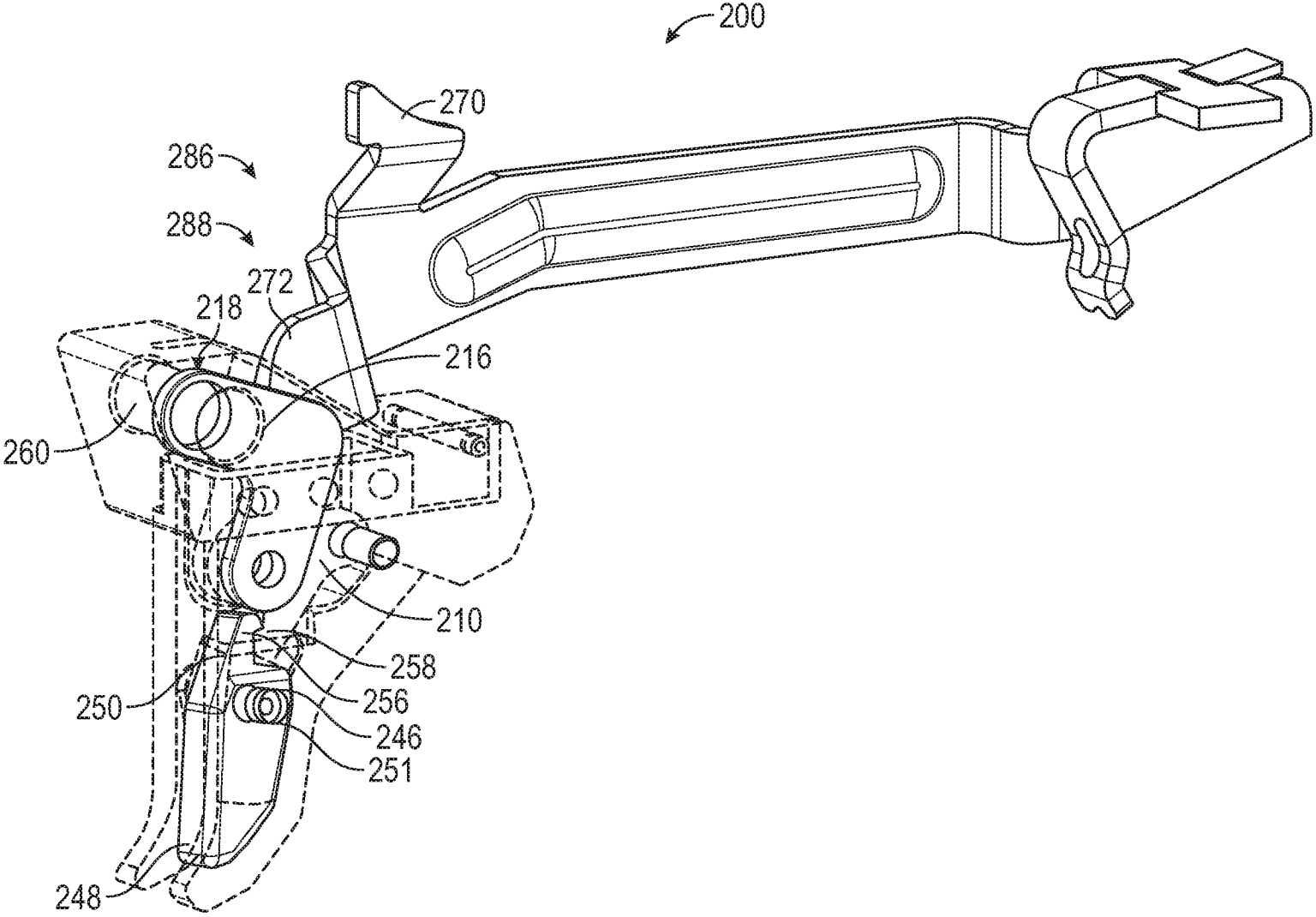
FIG. 6B is a partial-translucent and partial-exploded view of the trigger assembly of FIG. 6A in a dischargeable position in accordance with one example embodiment of the disclosure.

The trigger assembly 100 can also include the brace 110 coupled to the trigger bar 183, the trigger shoe 102, and the joint 116. The brace 110 can include the first brace end 112 and the second brace end 114. In some examples, the brace 110 is an elongated member with rounded ends. In other examples, the brace can be a variety of other shapes such as rectangular, triangular, circular, or other oblong shape (e.g., brace 210, as shown in FIG. 6A). The first brace end 112 can include a first brace end aperture 111. The second brace end 114 can include a second brace end aperture 113 alighted with a brace pin aperture 123. The brace 110 can be a rigid structure through which a force acts on the first brace end 112 that translates to the second brace end 114. In this manner, the trigger shoe aperture 121 and the brace pin aperture 123 simultaneously move in unison.

The trigger assembly 100 can also include the joint 116 coupled to the brace 110. The joint 116 can include a first joint end 118 and a second joint end 120. In some examples, the joint 116 is an L-shaped member. For example, the joint can include a first joint member that extends from the first joint end 118, and a second joint member that extends from the second joint end 120. The first joint member and the second joint member can meet and define an angle of substantially 90 degrees. In other examples, the joint 116 may have any other shape, such as arcuate or straight from the first joint end 118 to the second joint end 120. The first joint end 118 can include a first joint end aperture 119 that aligns with the brace pin aperture 123 that extends from the first joint end 118, through the second brace end 114, to the leg aperture 173. In this manner, movement of the trigger shoe 102 translates through the brace 110 to the first joint end 118 of the first joint 116. The movement of the first joint end 118 then translates through the joint 116 to the second joint end 120. As shown in FIGS. 9A-9D, a trigger pin 262 extends through a trigger pin aperture 160 in the second joint end aperture 129 on the second joint end 120. Referring to FIG. 1A, the second joint end 120 includes a trigger pin aperture 160 that secures the trigger pin 262. In some examples, as the first joint end 118 moves, the joint 116 rotates clockwise or counter clockwise due to the second joint end 120 being coupled to the trigger pin 262.

The trigger assembly 100 can include the trigger hood 126 coupled to the trigger shoe 102. The trigger hood 126 can include a top surface 127, the bottom surface 128, and a track 130 disposed between the top surface 126 and the bottom surface 128. In some examples, the track 130 is disposed along the bottom surface 128 of the trigger hood 126. The track 130 can include a keyway slot 138. That is, the keyway slot 138 can include two channels opposite one another disposed along the bottom surface 128 of the trigger hood 126. The keyway slot 138 can receive a key 140 disposed on or adjacent to the top surface 108 of the trigger shoe 102. In this manner, the keyway slot 138 guides the trigger shoe 102 as the trigger shoe 102 moves along the keyway slot 138. In certain example embodiments, the keyway slot 138 and the key 140 have complementary shapes so that all or a portion of key 140 will fit into the keyway slot 138. As shown in FIG. 1A, in one example the keyway slot 138 and the key 140 are substantially rectangular. In other examples, the keyway slot 138 and the key 140 can be circular, triangular, or some other shape. The trigger hood 126 can also include a variety of channels, such as a trigger bar channel 159. The trigger bar channel 159 complements the trigger bar 164 and can receive the trigger bar 164 during movement of the trigger shoe 102. Each embodiment described herein can interchange the tracks described herein (e.g., track 130, track 230, etc.). In other embodiments, the trigger shoes and trigger hoods described herein could include other types of tracks or joints about each move in relation to one another (e.g., translational joint, slot joint, cylindrical joint, hinge, etc.).

The trigger assembly 100 can include the trigger bar 164 coupled to the brace 110. In some examples, the trigger bar 164 includes an elongated body 165 with a front end 166, a rear end 167, a first face 168, and a second face 169. The trigger bar 164 can include a plunger safety tab 170 extending up from a top surface of the elongated body 165 adjacent to the front end 166. The plunger safety tab 170 can extend substantially perpendicular to the body 165. In certain examples, the plunger safety tab 170 is configured to disengage the plunger safety (not shown) within a firearm receiver as the trigger bar 164 moves towards the butt of the firearm. The front end 166 of the trigger bar 164 can include a laterally extending leg 172 that is acutely angled relative to the body 165. The laterally extending leg 172 can include a leg aperture 173 at the front end 166 that extends through the leg 172. The leg aperture 173 can receive the brace pin 124 therethrough to couple the trigger bar to the brace 110. In this manner, movement of the brace 110 translates through the brace pin 124 to the front end 166 of the trigger bar 164. The movement of the front end 166 of the trigger bar 164 can then translate to the rear end 167 of the trigger bar 164 to discharge the firearm. In some examples, the rear end 167 of the trigger bar 164 includes a cruciform 171. The cruciform 171 can include a first arm 174, a second arm 175, and a third arm 176. For example, the first arm 174 can extend perpendicularly or substantially perpendicularly out from a side wall of the body 165. The second arm 175 can extend perpendicularly or substantially perpendicularly out from the first arm 174 towards the rear end 167 of the trigger bar 164. The second arm 175 can be angled away from the first arm 174 to catch a firing pin upon discharge of the firearm. The third arm 176 can extend perpendicular to the first arm 174 partially towards the front end 166 of the body 165. In some examples, the first arm 174 is arcuate and includes a trigger spring aperture to receive a trigger spring (not shown). In other embodiments, the trigger bar may not have a crucible. Additionally, the trigger bar may have the components described herein located in different positions along the body. For example, the trigger bar may include the plunger safety near the butt end of the firearm. In yet other embodiments, trigger bars from various known firearms may be coupled to the trigger assembly to permit lateral movement of the trigger shoe as described herein.

As shown in FIGS. 5A and 5B, the trigger assembly 100 fits within a grip 178 of a firearm (as depicted in FIG. 5A). In some examples, the trigger assembly 100 is lowered within the grip 178 from the top grip side 179 towards the bottom grip side 180. The trigger assembly 100 fits within the grip 178 so that the trigger shoe 102 is disposed within the trigger guard 183 through the grip trigger slot 184. That is, the trigger hood 126 anchors into the grip trigger slot 184 within the grip 178 so that a trigger pin 162 (not shown) secures within the trigger pin aperture 160. The trigger assembly 100 can extend from the trigger slot 184 towards the butt end 182 of the grip 178.

FIGS. 6A-7C are various views of a trigger assembly 200 in different positions in accordance with another example embodiment of the disclosure. FIGS. 8A-8H are various views of the trigger assembly 200 of FIGS. 6A-7C in accordance with the other example embodiment of the disclosure. Referring now to FIGS. 6A-8H, the trigger assembly 200 can include a trigger shoe 202, a brace 210, a joint 216, a trigger hood 226, a trigger lever 244, a trigger shoe stop 242, and a trigger bar 264 coupled together to discharge a firearm (not shown). In some examples, the trigger lever 244 engages the brace 210 in a safety position 285. The trigger lever 244 can rotate about the trigger lever pin 254 to disengage the brace 210 into the dischargeable position 286 (e.g., as shown in FIG. 6B). The trigger shoe 202 and the brace 210 includes a trigger shoe pin aperture 221 extending through the trigger shoe 202 and a second brace end 214 of the brace 210. That is, the second brace end 214 can include a second brace end aperture 215 that aligns with the trigger shoe pin aperture 221. The trigger shoe 202 and the brace 210 are secured together by a trigger shoe pin 222. In this manner, as the trigger shoe 202 actuates, the brace 210 is pulled in the same direction of the trigger shoe actuation. At a first brace end 212, a brace pin aperture 223 extends through the joint 216, the second brace end 214, and a leg aperture 273 of the trigger bar 264. In this manner, any actuation of the trigger shoe 202 translates from the trigger shoe 202, through the brace 210, and onto the joint 216 and the trigger bar 264. For example, as shown in FIG. 6A, the trigger shoe 202 is guided along a bottom surface 228 of the trigger hood 226. As the trigger shoe 202 moves along the bottom surface 228 of the trigger hood 226, the other components move simultaneously as the trigger shoe 202.

Referring now to FIG. 6A, the trigger shoe 202 can include a first surface 204, a second surface 206, and a top surface 208. In some examples, the first surface 204 is substantially flat. In other examples, the first surface 204 can be another shape, such as arcuate. The second surface 206 can be angled towards the first surface 204, thereby meeting the first surface 204 at a point. Between the first surface 204 and the second surface 206 can be a trigger shoe aperture 221 extending perpendicular to the first surface 204. The trigger shoe aperture 221 may extend in a variety of other directions within the trigger shoe 202. The trigger shoe aperture 221 can complement the shape of the trigger shoe pin 222 by which the trigger shoe aperture 221 receives the trigger shoe pin 222.

The trigger assembly 200 can include the trigger lever 244 with a first end 246 and a second end 248. In some examples, the first end 246 includes a first latch portion 256. The first latch portion 256 can be a surface angled away (e.g., perpendicular) to the rest of the surface of the trigger lever 244. In this manner, the first latch portion 256 can engage a second latch portion 258 extending from the brace 210 in the safety position 286. The trigger lever 244 can rotate to disengage the second latch portion 258 into the dischargeable position 286 in which the trigger shoe 202 may then move. The trigger lever 244 can rotate about the trigger lever pin 254 in a clockwise and counterclockwise direction. The second end 248 of the trigger lever 244 protrudes from within the trigger shoe 202 in the safety position 286 and can recede within the trigger shoe 202 in the dischargeable position 286. In some examples, the trigger lever 244 includes an indent 250 and a spring 252 disposed within the indent 250. The spring 252 can extend towards an inner surface of the trigger shoe 202. In other examples, the trigger shoe 202 includes an indent opposite the trigger lever indent 250. The spring 252 can be a compression spring that moves the trigger lever 244 back to the safety position 285 when the trigger lever 244 is moved to the dischargeable position 286, as described herein.

The trigger assembly 200 can include the brace 210 with a first brace end 212 and a second brace end 214. In some examples, the brace 210 is an elongated shape with rounded ends. In other examples, the brace can be a variety of other shapes such as rectangular, triangular, circular, or other oblong shape. The second brace end 214 can include a trigger shoe aperture 221. The first brace end 214 can align a brace pin aperture 223. The brace 210 can be a rigid structure through which a force acts on the second brace end 214 that translates to the first brace end 212. In this manner, the trigger shoe aperture 221 and the brace pin aperture 223 simultaneously move. The brace 210 can include a second latch portion 258 that extends from the brace 210. For example, the brace 210 can be secured within the trigger shoe 202, and the second latch portion 258 can extend toward the trigger lever 244. The second latch portion 258 can have a surface that contacts the first latch portion 256 on the trigger lever 244. In other examples, the latch portions can be hooks or some other connection to prevent trigger shoe 202 movement.

The trigger assembly 200 can include the joint 216 with a first joint end 218 and a second joint end 220. In some examples, the joint 216 is an L-shaped member where the first joint end 218 extends, turns 90 degrees, and then extends to the second joint end 220. For example, the joint 216 can include a first joint member that extends from the first joint end 218 and a second joint member that extends from the second joint end 220. The first joint member and the second joint member can meet and define an angle of substantially 90 degrees. In other examples, the joint 216 may be another shaped member, such as arcuate or straight from end to end. The first joint end 218 can include the brace pin aperture 223 that extends from the first joint end 218, through the second brace end 214, to the leg aperture leg 273. In this manner, the movement of the trigger shoe 202 translates through the brace 210 to the first joint 218. The actuation of the first joint end 218 then translates through the joint 216 to the second joint end 220. As shown in FIGS. 9A-9D, a trigger pin 262 extends through the second joint end 220. Referring to FIG. 6A, the second joint end 220 includes a trigger pin aperture 260 that secures the trigger pin 262. In some examples, as the first joint end 218 moves, the joint 216 rotates clockwise or counter clockwise due to the second joint end 220 secured onto the trigger pin 262.

The trigger assembly 200 can include the trigger hood 226 with a top surface 227, a bottom surface 228, and a track 230. In some examples, the track 230 is disposed along the bottom surface 228 of the trigger hood 226. The track 230 can include a first groove 232 aligned with a second groove 234 disposed on the trigger shoe 202. The first groove 232 and the second groove 234 can secure a plurality of ball bearings 236 therebetween. For example, the grooves can secure two or more ball bearings to roll between the grooves. In this manner, as a force acts upon (e.g., moves) the trigger shoe 202, the ball bearings 236 roll between the grooves, thereby guiding the trigger shoe 202 in the directions of the grooves. The first groove 232 and the second groove 234 can be substantially linear with the firearm slide (not shown). In other examples, the first groove 232 and the second groove 234 can be angled relative to the firearm slide. The trigger hood 226 can include a variety of channels, such as a trigger bar channel 259. The trigger bar channel 259 complements the trigger bar 264 and can receive the trigger bar 264 during actuation of the trigger shoe 202.

The trigger assembly 200 can include a trigger shoe stop 242 attached to the trigger hood 226 via a trigger hood pin 225. The trigger shoe stop 242 can be attached to the trigger hood 226 at the end of the track 230. The trigger shoe stop 242 can be semi-circular. In other examples, the trigger shoe stop 242 can be another shape such as rectangular, triangular, cubic, or some other shape that prevents further movement along the track 230.

The trigger assembly 200 can include the trigger bar 264. In some examples, the trigger bar 264 includes a body 265 with a front end 266, a rear end 267, a first face 268, and a second face 269. The trigger bar 264 can include a plunger safety tab 270 extending adjacent to the front end 266. The plunger safety tab 270 can extend substantially perpendicular to the body 265. In this manner, the plunger safety tab 270 can disengage the plunger safety (not shown) within a firearm receiver as the trigger bar 264 is moved. At the front end 266 of the trigger bar, a laterally extending leg 272 is angled relative to the body 265. The laterally extending leg 272 can include a leg aperture 273 at the front end 266. The leg aperture 273 can receive the brace pin 224 therethrough. In this manner, actuation of the brace 210 translates through the brace pin 224 to the trigger bar 264. The actuation of the trigger bar 264 translates to the rear end 267 of the trigger bar 264 to discharge the firearm. In some examples, the trigger bar rear end 267 includes a cruciform 271. The cruciform 271 includes a first arm 274, a second arm 275, and a third arm 276. For example, the first arm 274 can extend perpendicular to the body 265. The second arm 275 can extend perpendicular to the first arm 274 towards the rear end 267 of the trigger bar 264. The second arm 275 can be angled away from the first arm 274 to catch a firing pin upon discharge of the firearm. The cruciform 271 third arm 276 can extend perpendicular to the first arm 274 towards the front end 266 of the body 265. In some examples, the first arm 274 actuates and includes a trigger spring aperture to receive a trigger spring (not shown). In other embodiments, the trigger bar may not have a crucible. Additionally, the trigger bar may have the components described herein located in different positions along the body. For example, the trigger bar may include the plunger safety near the butt end of the firearm. In yet other embodiments, trigger bars from various known firearms may be coupled to the trigger assembly to permit lateral movement of the trigger shoe as described herein.

Figure 6C:
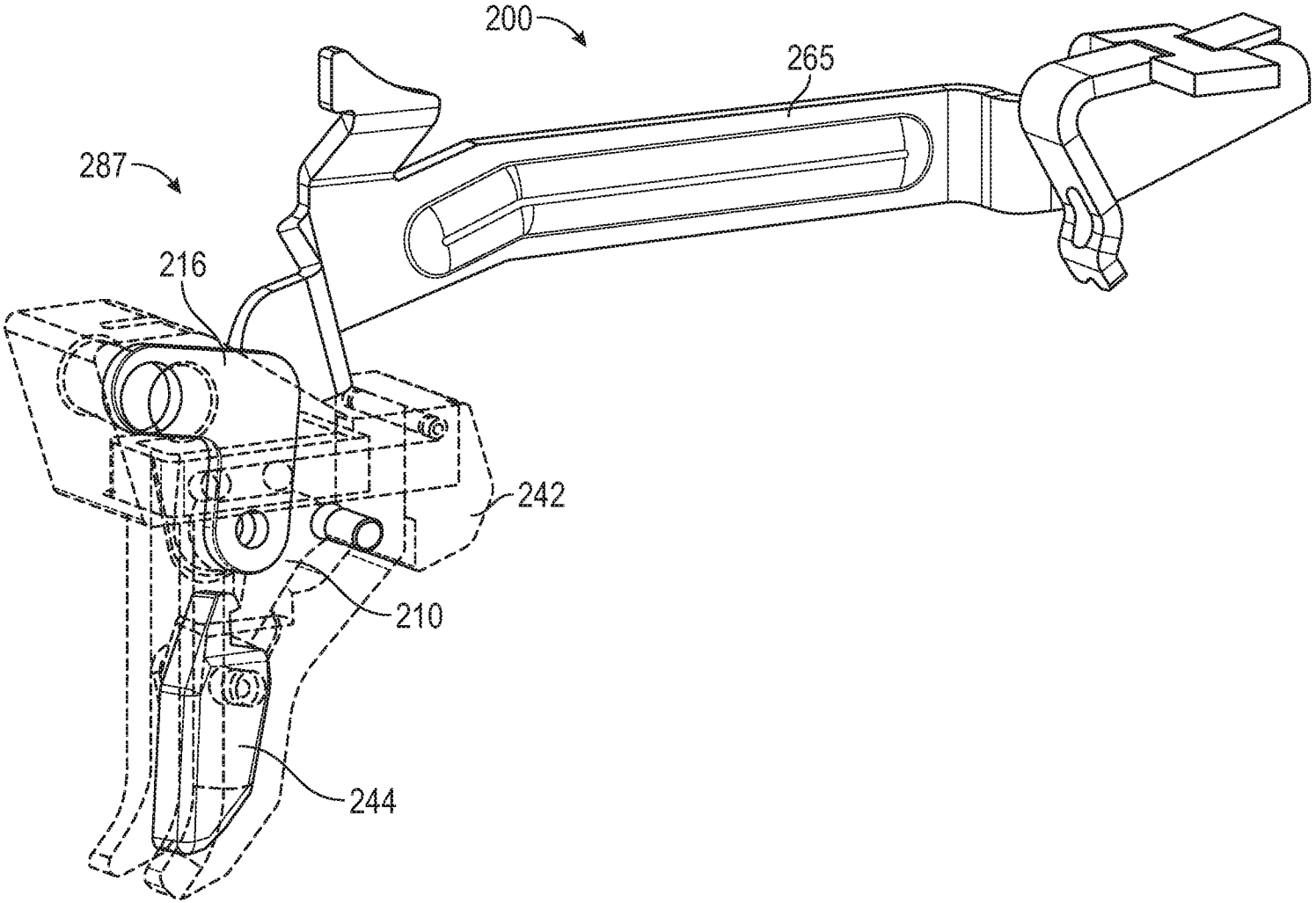
FIG. 6C is a partial-translucent and partial-exploded view of the trigger assembly of FIG. 6A in a discharged position in accordance with one example embodiment of the disclosure.
Figure 7A:
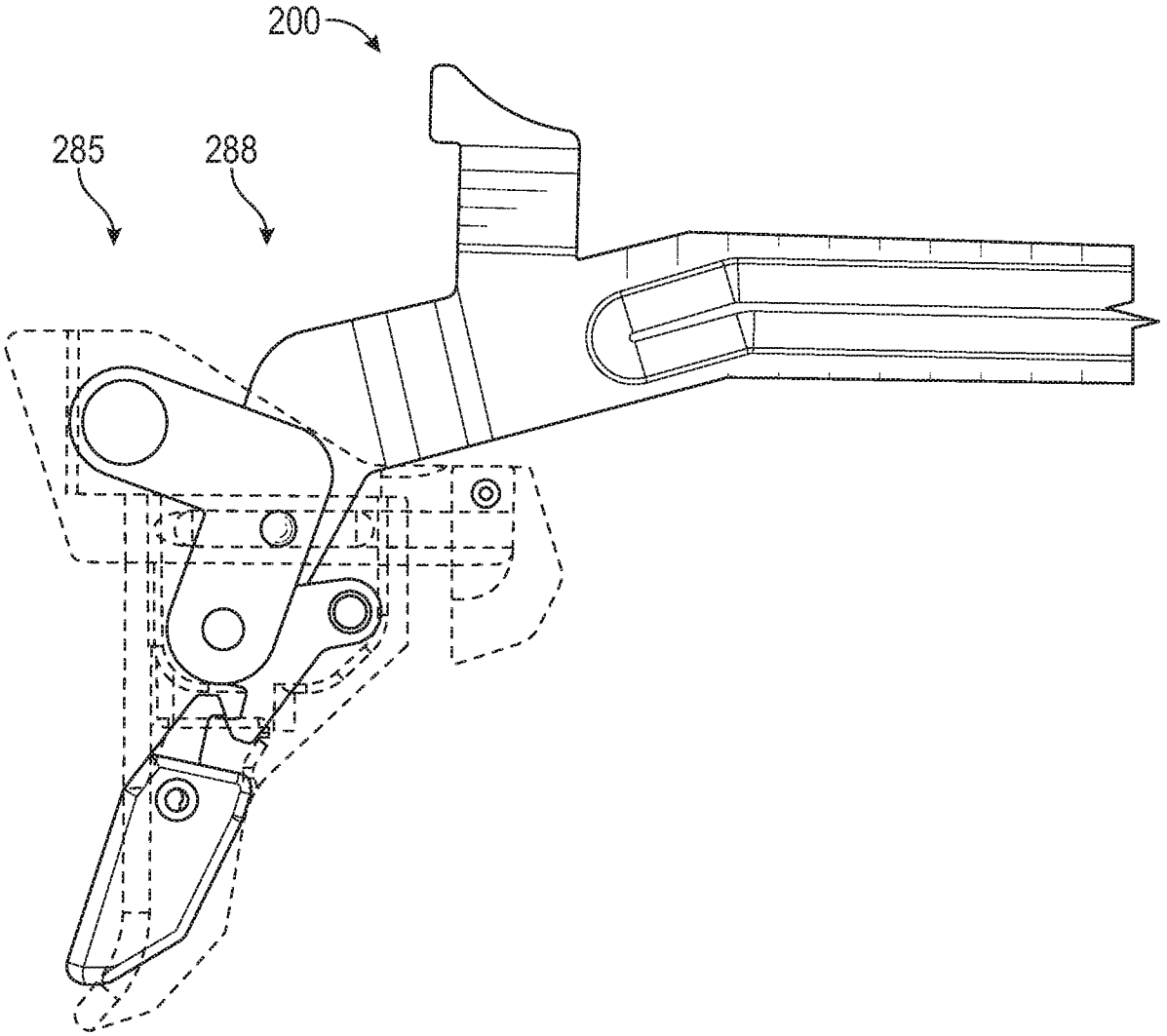
FIG. 7A is a partial-translucent side elevation view of a trigger assembly in a safety position in accordance with one example embodiment of the disclosure.
Figure 7B:
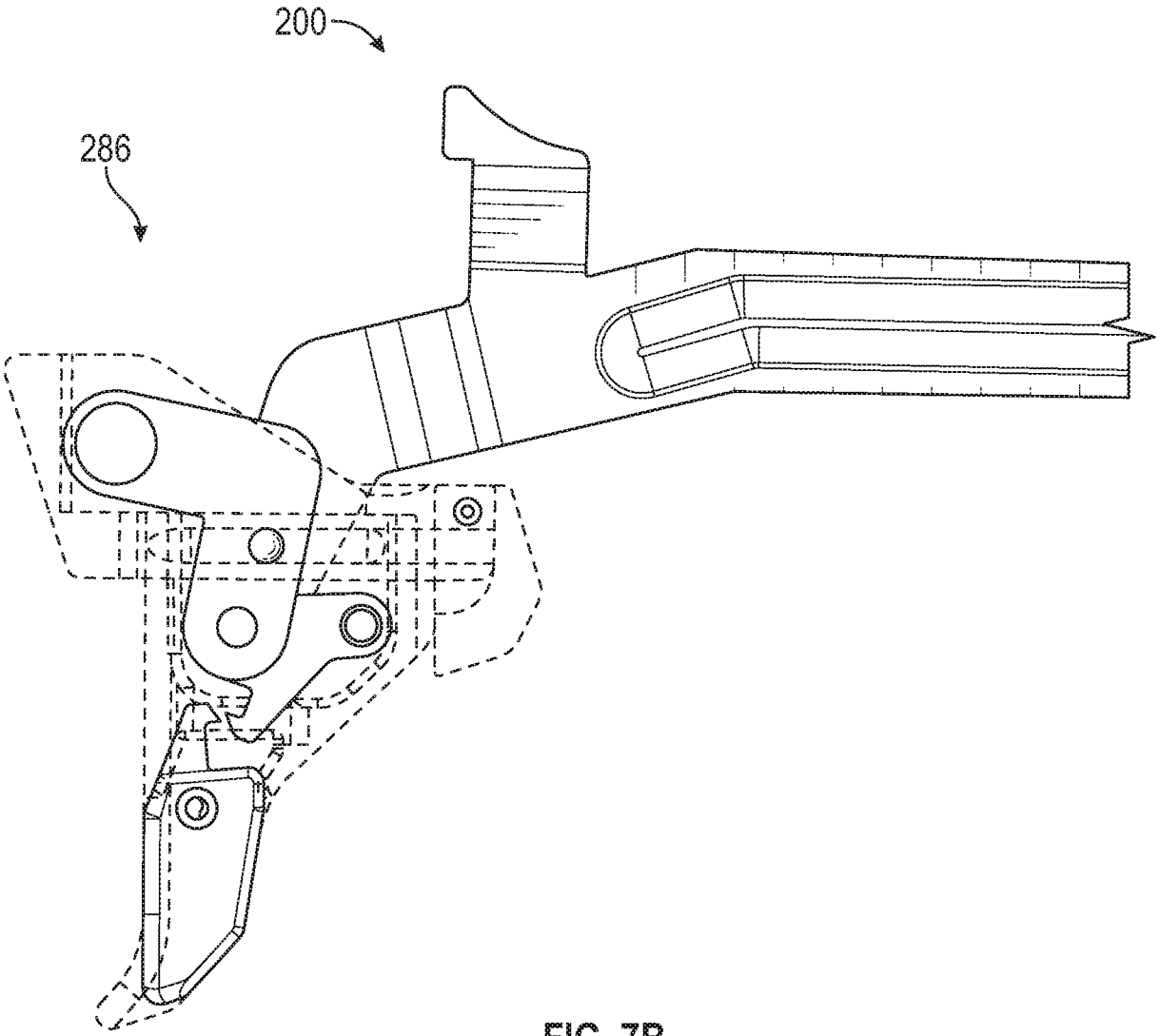
FIG. 7B is a partial-translucent side elevation view of the trigger assembly of FIG. 7A in a dischargeable position in accordance with one example embodiment of the disclosure.
Figure 7C:
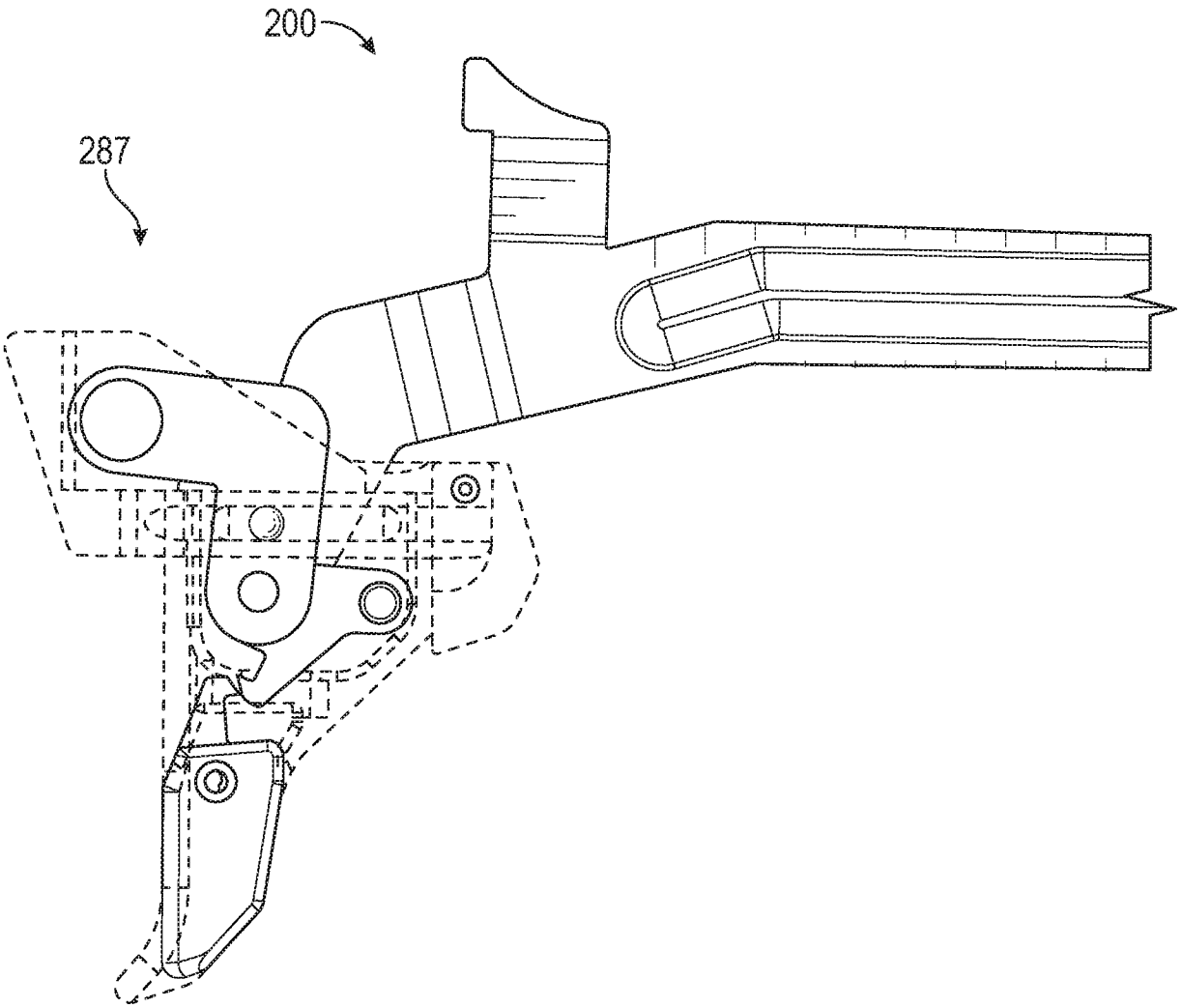
FIG. 7C is a partial-translucent side elevation view of the trigger assembly of FIG. 7A in a discharged position in accordance with one example embodiment of the disclosure.
Figure 8A:
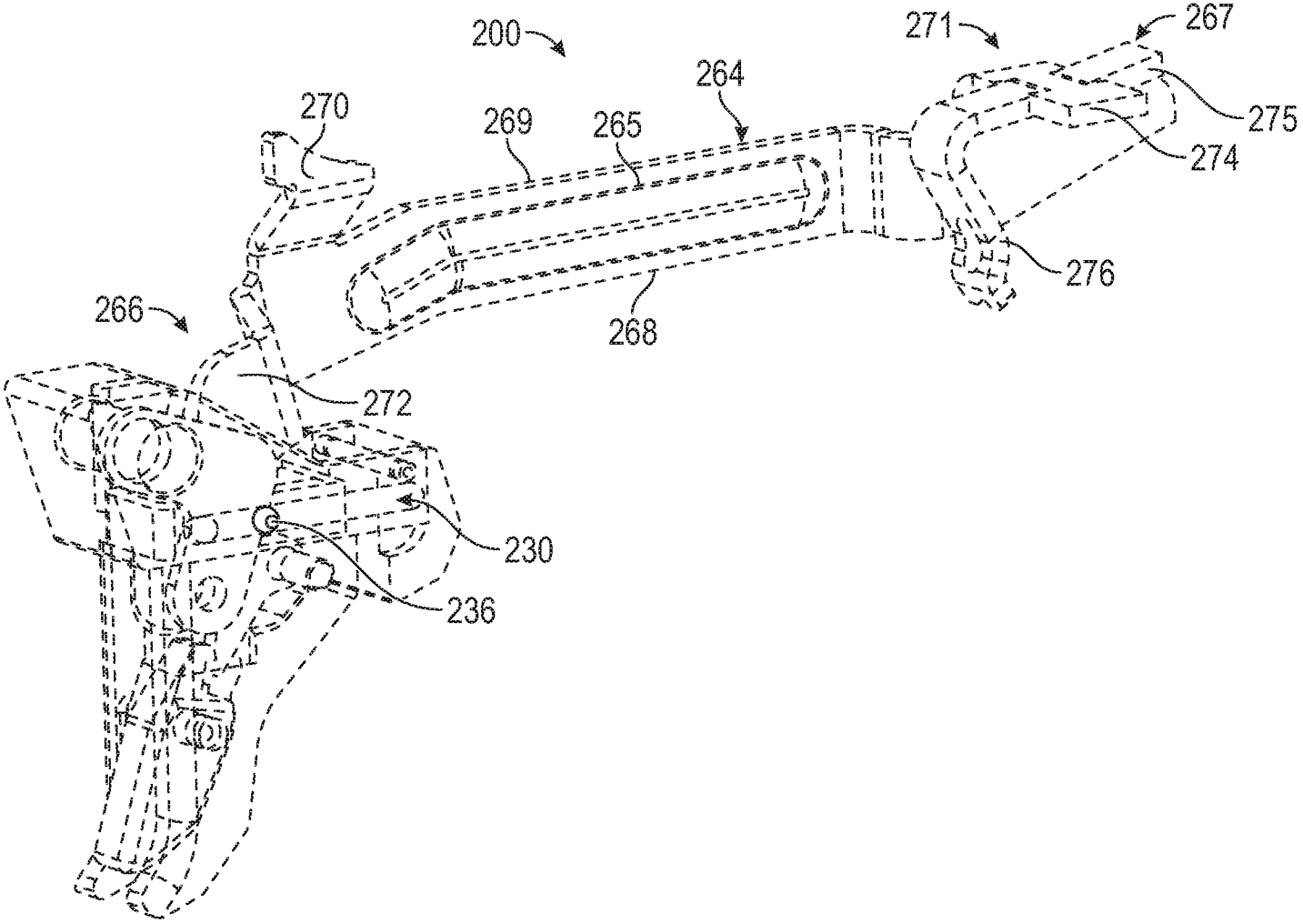
FIG. 8A is a partial-transparent perspective view of a trigger assembly in accordance with one example embodiment of the disclosure.
Figure 8B:
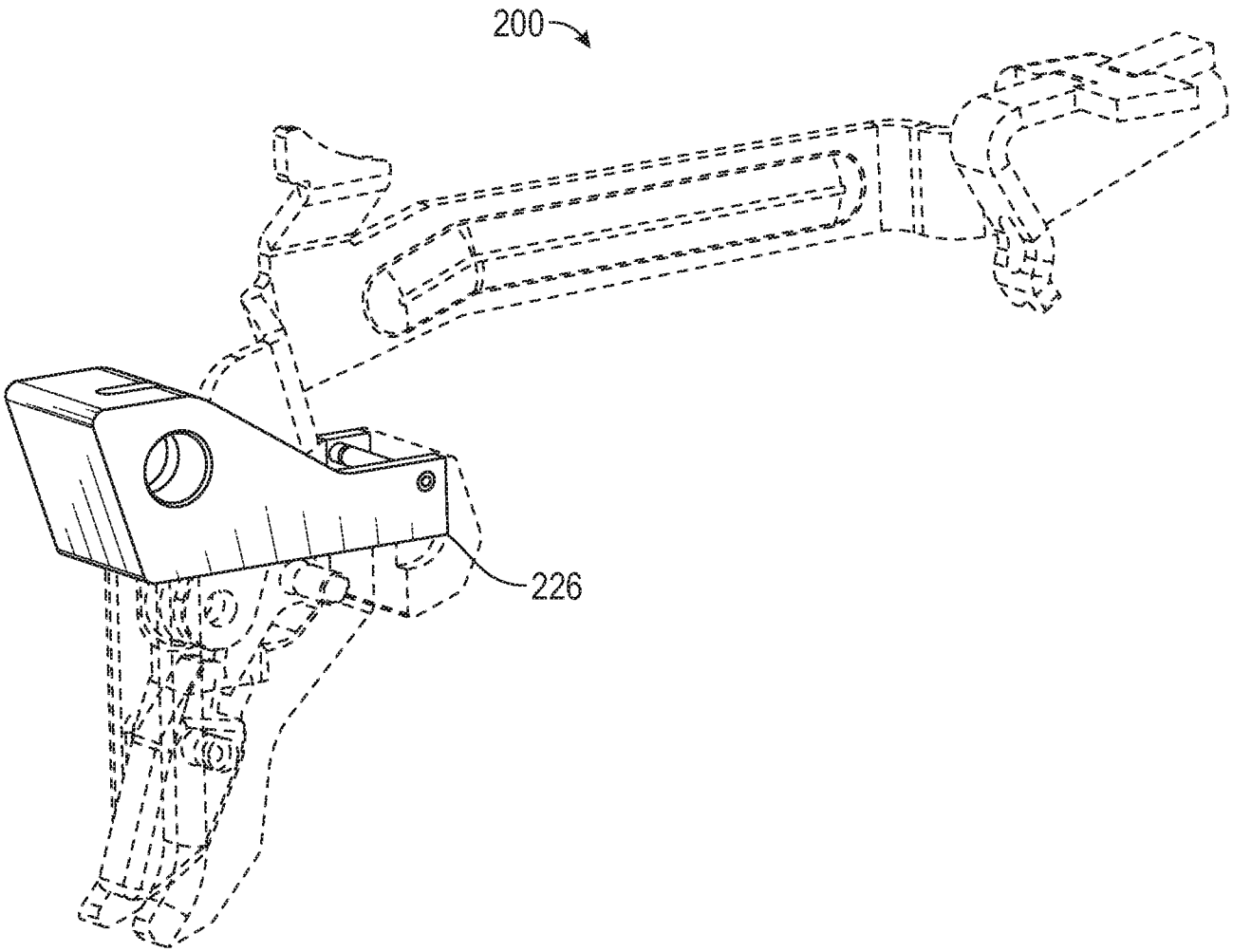
FIG. 8B is a partial-transparent perspective view of the trigger assembly of FIG. 8A in accordance with one example embodiment of the disclosure.
Figure 8C:
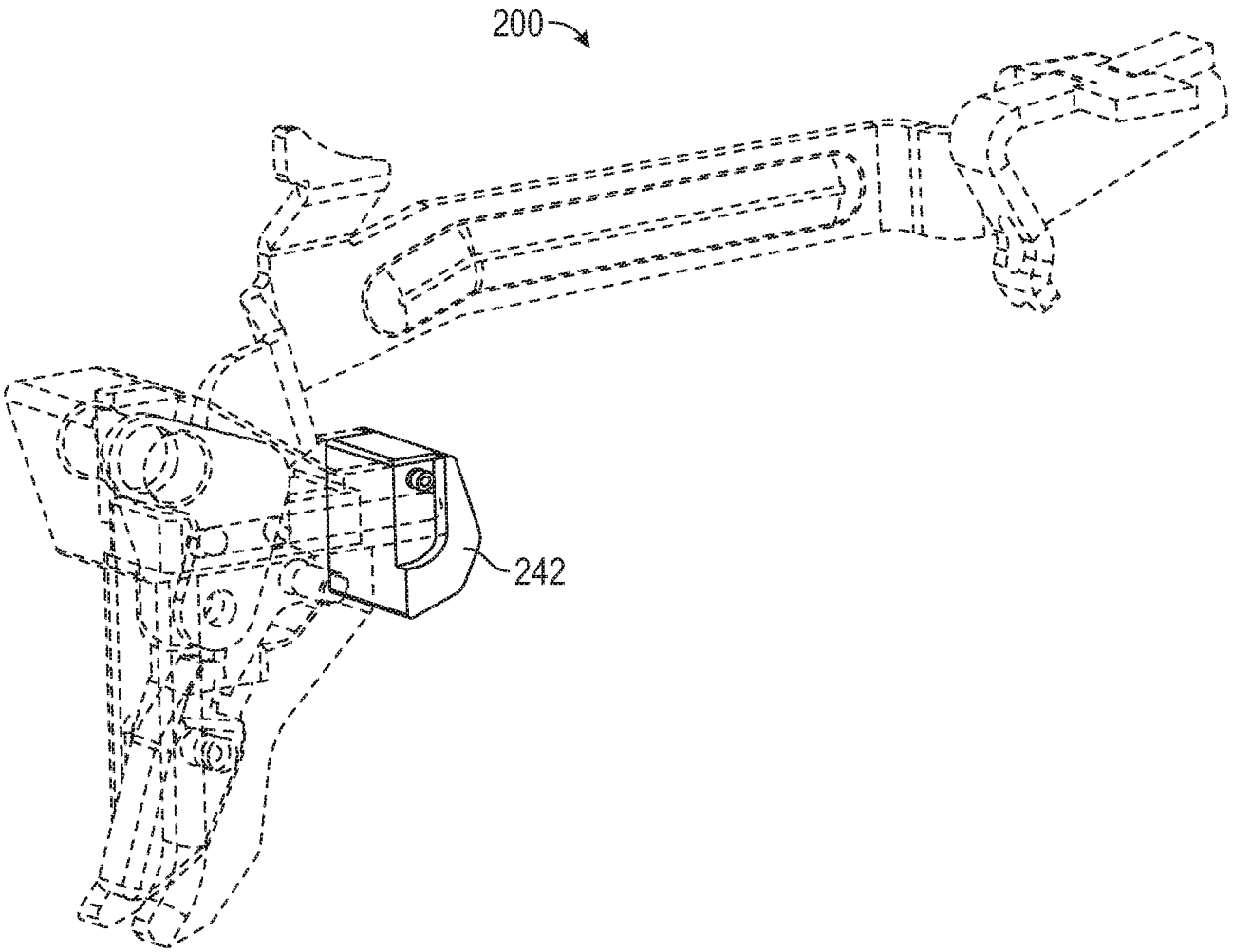
FIG. 8C is a partial-transparent perspective view of the trigger assembly of FIG. 8A in accordance with one example embodiment of the disclosure.
Figure 8D:
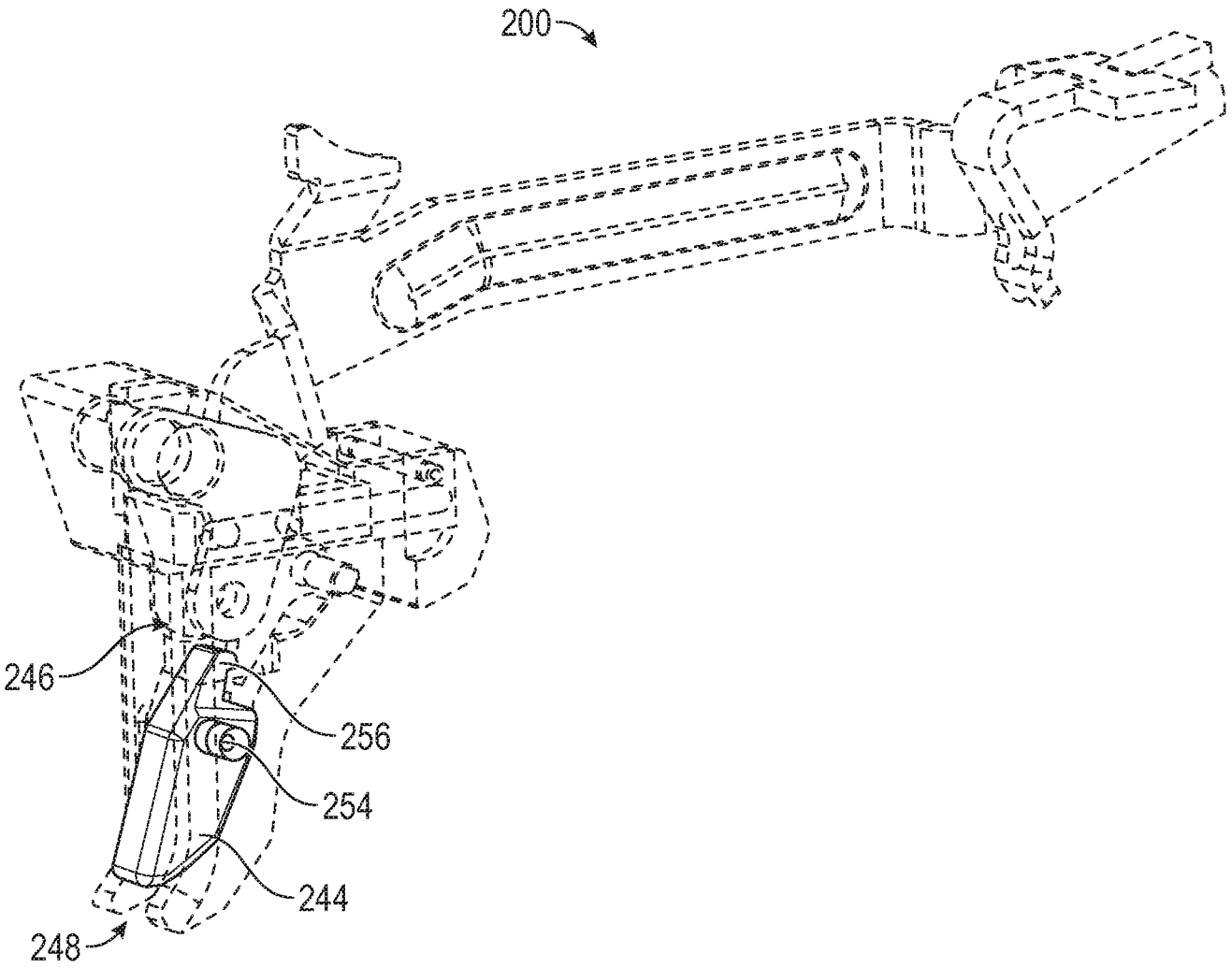
FIG. 8D is a partial-transparent perspective view of the trigger assembly of FIG. 8A in accordance with one example embodiment of the disclosure.
Figure 8E:
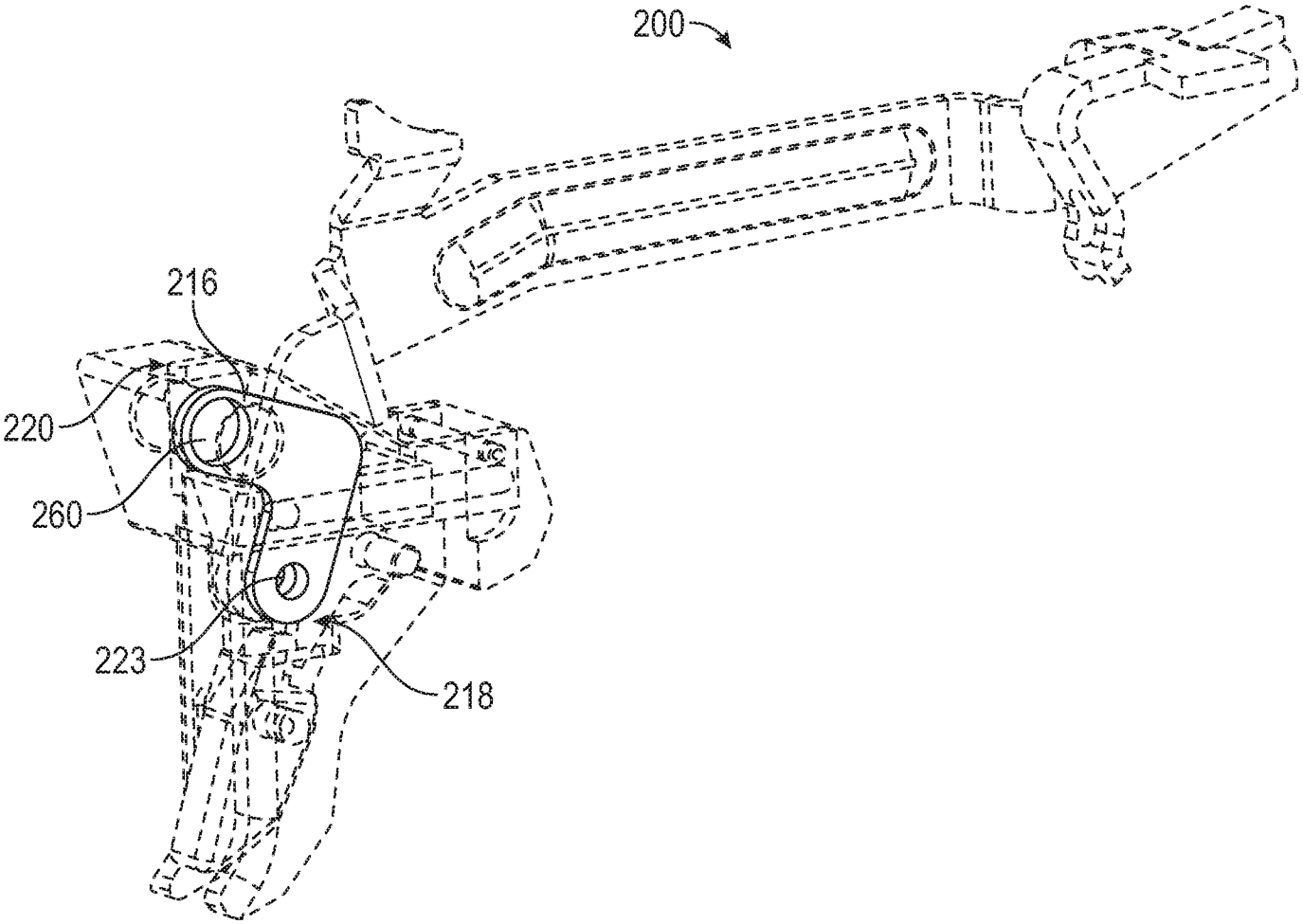
FIG. 8E is a partial-transparent perspective view of the trigger assembly of FIG. 8A in accordance with one example embodiment of the disclosure.
Figure 8F:
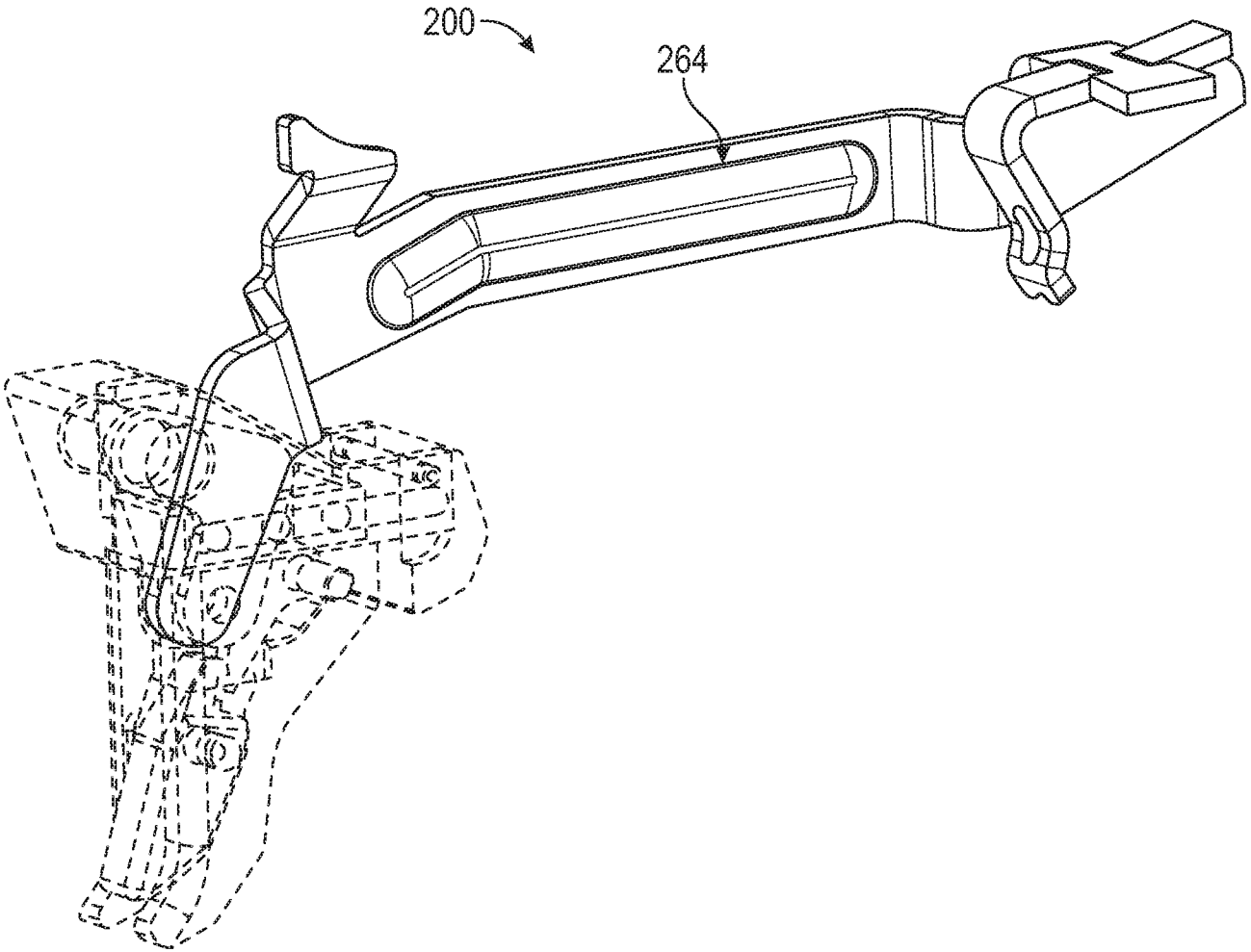
FIG. 8F is a partial-transparent perspective view of the trigger assembly of FIG. 8A in accordance with one example embodiment of the disclosure.
Figure 8G:
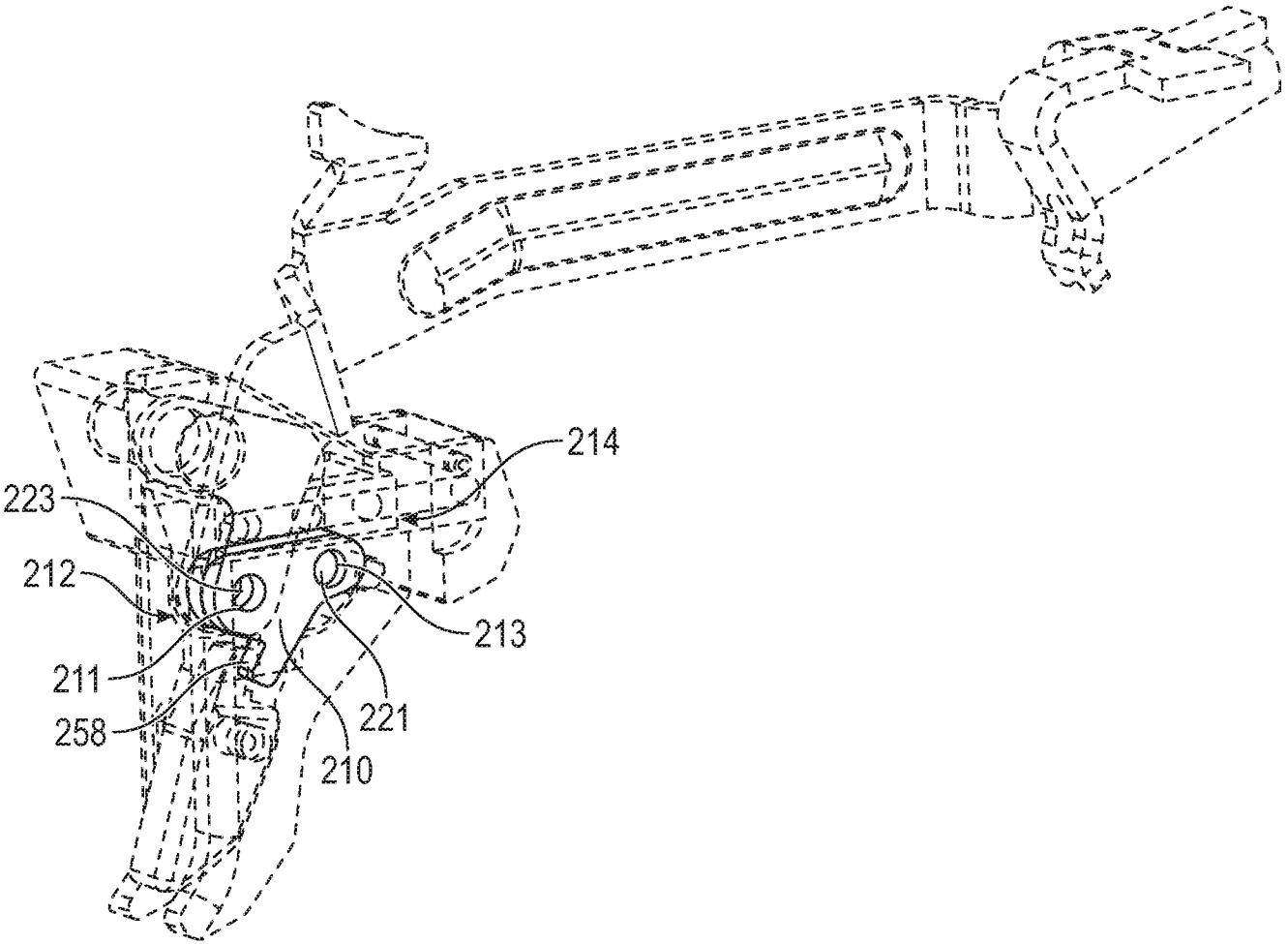
FIG. 8G is a partial-transparent perspective view of the trigger assembly of FIG. 8A in accordance with one example embodiment of the disclosure.
Figure 8H:
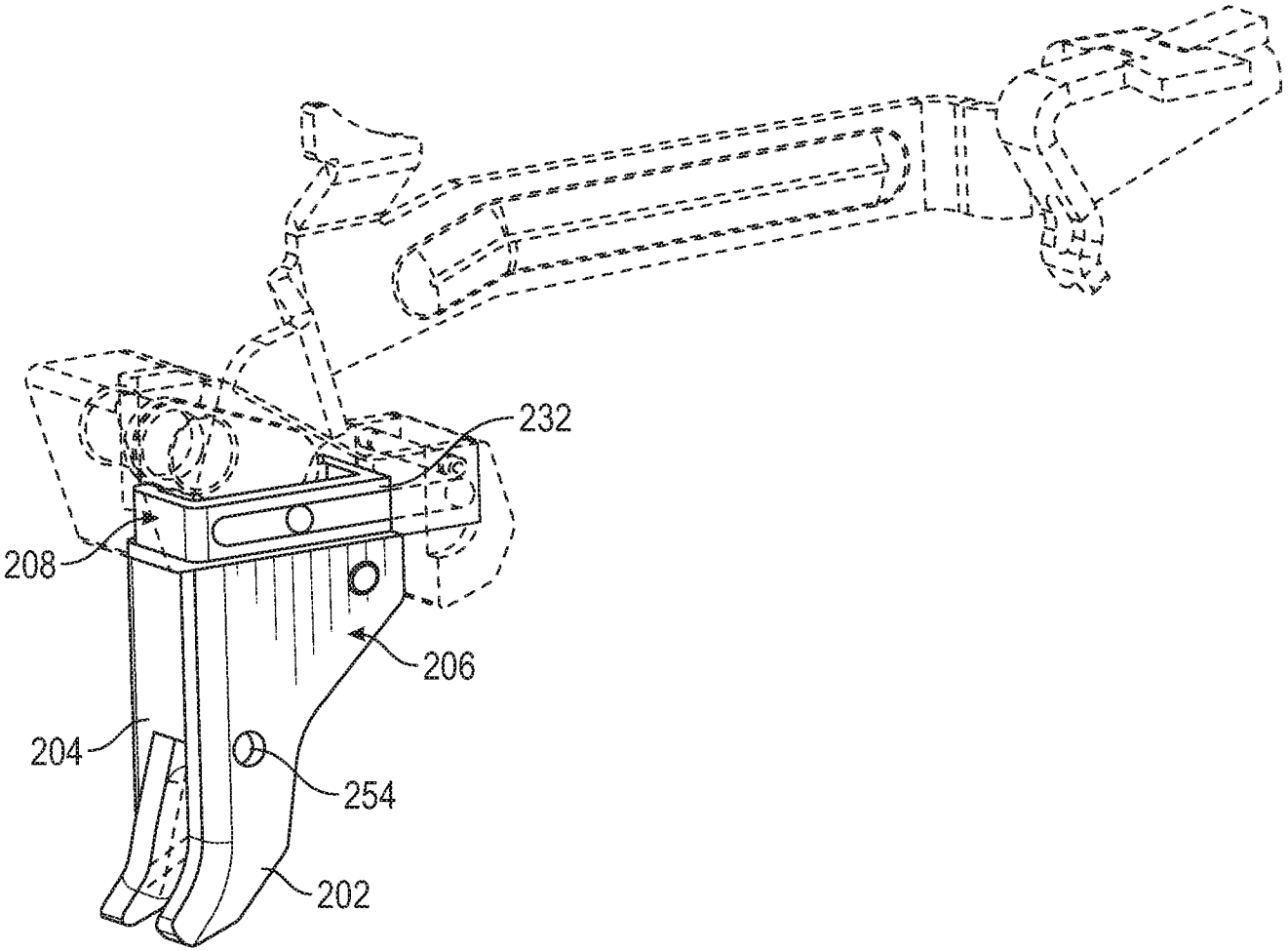
FIG. 8H is a partial-transparent perspective view of the trigger assembly of FIG. 8A in accordance with one example embodiment of the disclosure.
Figure 9A:
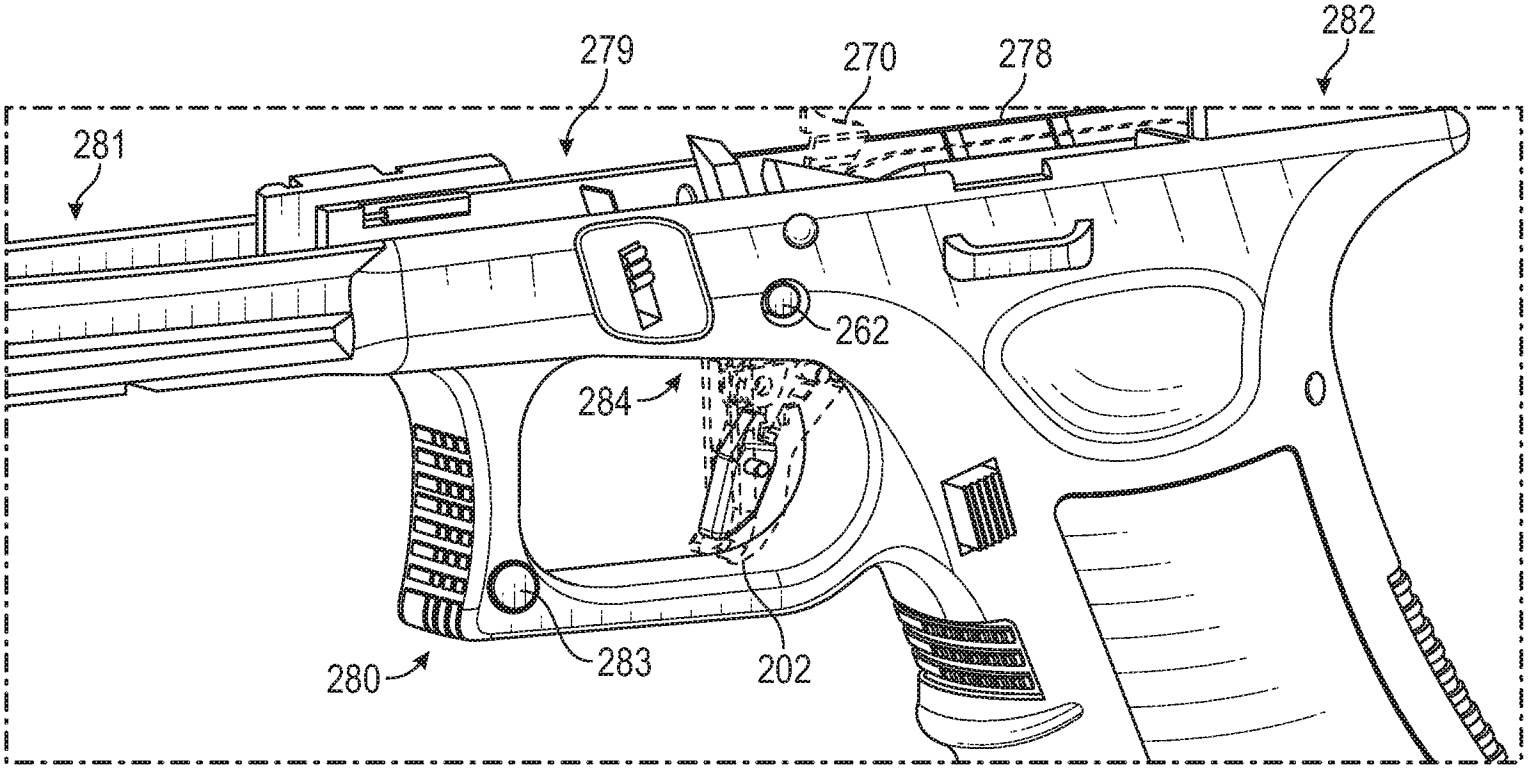
FIG. 9A is a partial-transparent perspective view of a trigger assembly incorporated into a firearm in accordance with one example embodiment of the disclosure.
Figure 9B:
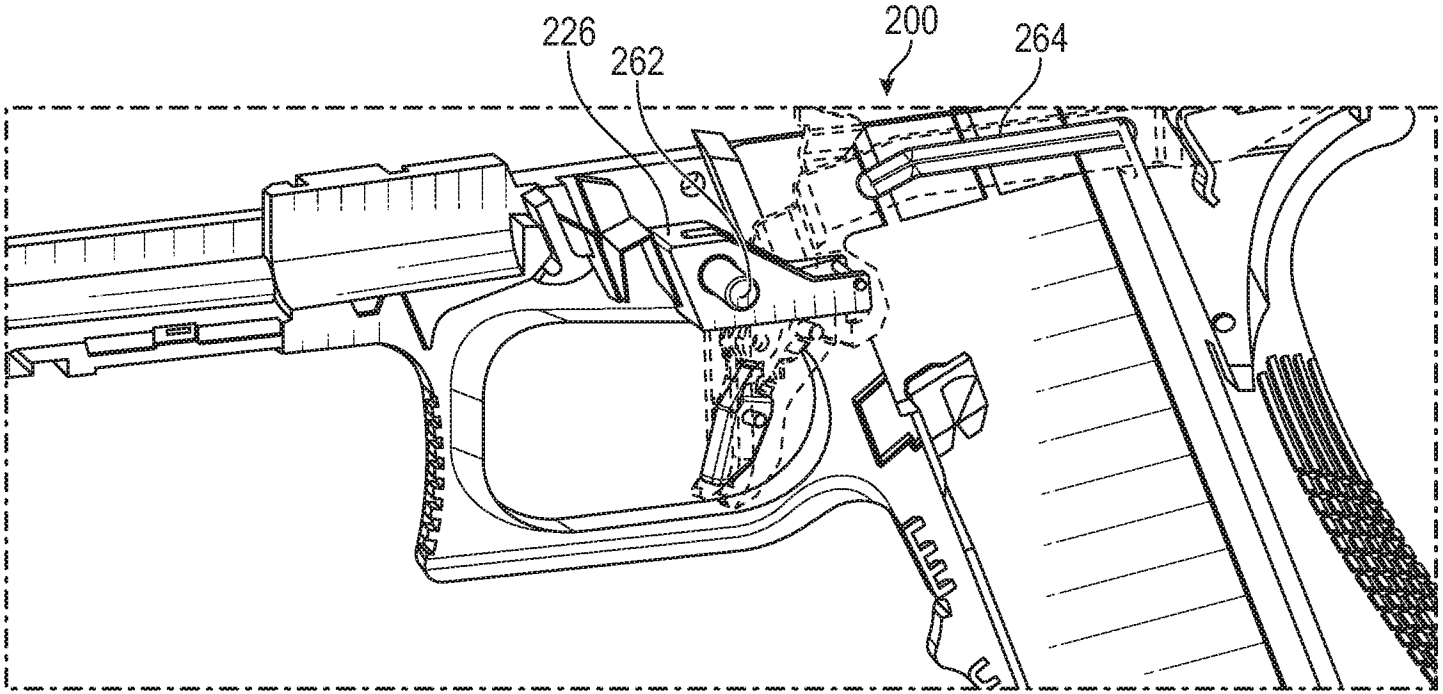
FIG. 9B is a cross-sectional, partial-transparent perspective view of the trigger assembly of FIG. 9A in accordance with one example embodiment of the disclosure.
Figure 9C:
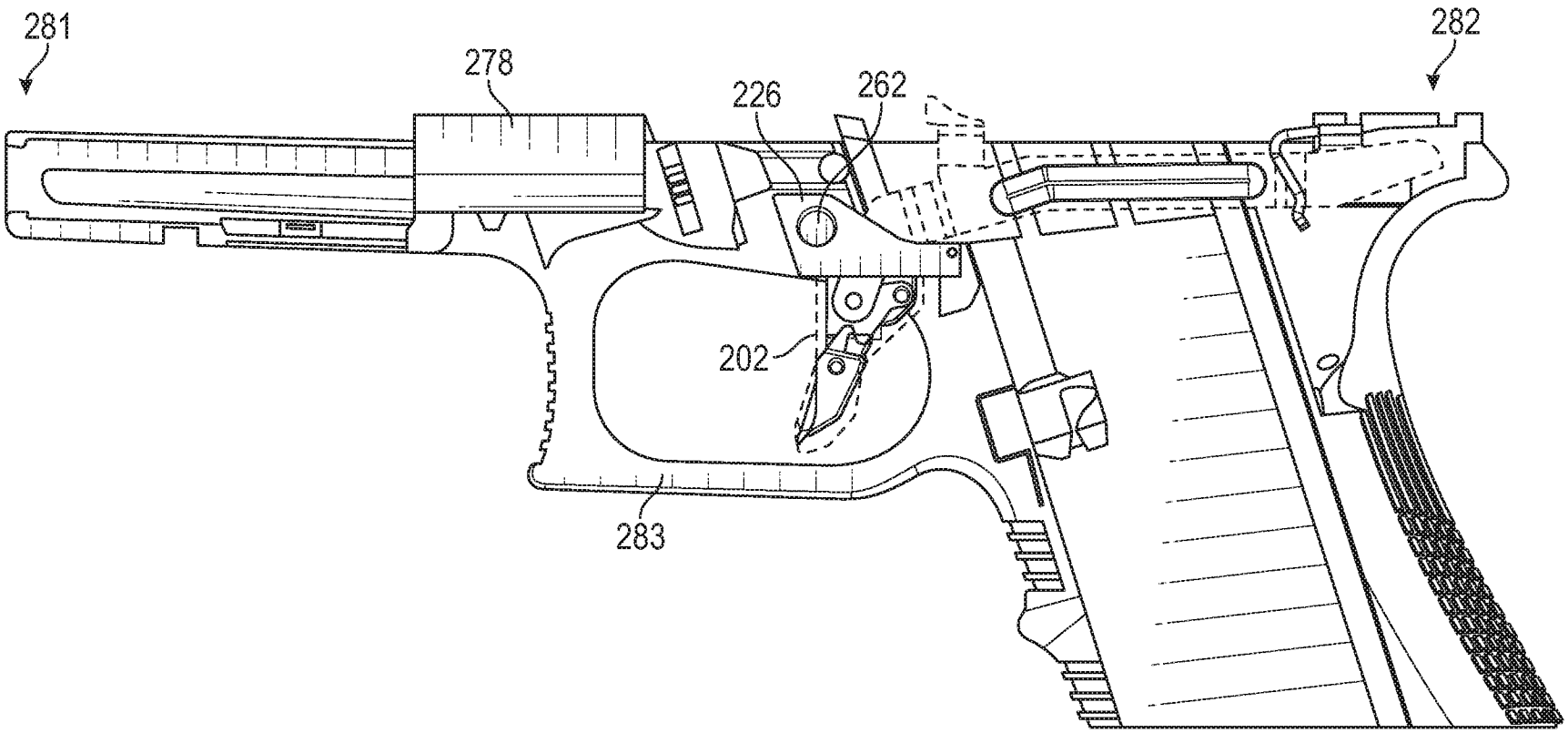
FIG. 9C is a cross-sectional, partial-transparent side view of the trigger assembly of FIG. 9A in accordance with one example embodiment of the disclosure.
Figure 9D:
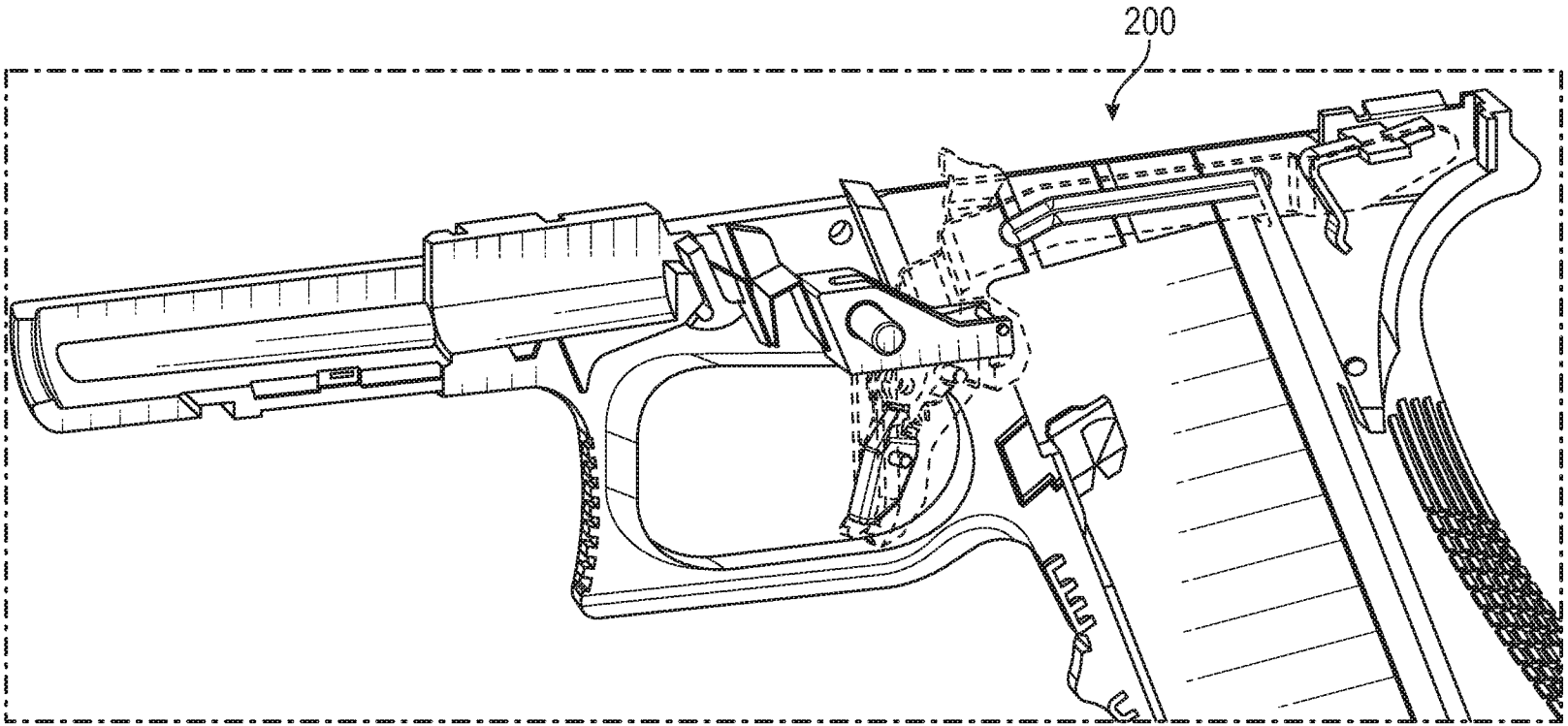
FIG. 9D is a cross-sectional, partial-transparent perspective view of the trigger assembly of FIG. 9A in accordance with one example embodiment of the disclosure.

FIGS. 6A-6C and 9C depict the trigger assembly 100 moving between a battery position 288 to the discharged position 287. In some examples, the battery position 288 includes the trigger shoe 202 positioned towards the muzzle end 281 (e.g., as shown in FIG. 9C) of a grip 278 within the trigger guard 283. As shown in FIG. 6C, the trigger lever 244 can rotate within the trigger shoe 202 thereby disengaging the brace 210 into a dischargeable position 286. The trigger shoe 202 can then slide towards the butt end 282 of the grip 278 along the track 230 (e.g., also in FIG. 1A as 130) into the discharged position 287.

FIGS. 9A-9D are various views of a trigger assembly 200 incorporated into a firearm grip 278 in accordance with another example embodiment of the disclosure. Referring now to FIGS. 6A-9D, the trigger assembly 200 can fit within a grip 278. In some examples, the trigger assembly 200 is lowered within the grip 278 from the top grip side 279 towards the bottom grip side 280. The trigger assembly 200 fits within the grip 278 so that the trigger shoe 202 can be disposed within the trigger guard 283 through the grip trigger slot 284. That is, the trigger hood 226 anchors into the grip trigger slot 284 within the grip 278 so that a trigger pin 262 (not shown) secures within the trigger pin aperture 260.

Figure 10A:
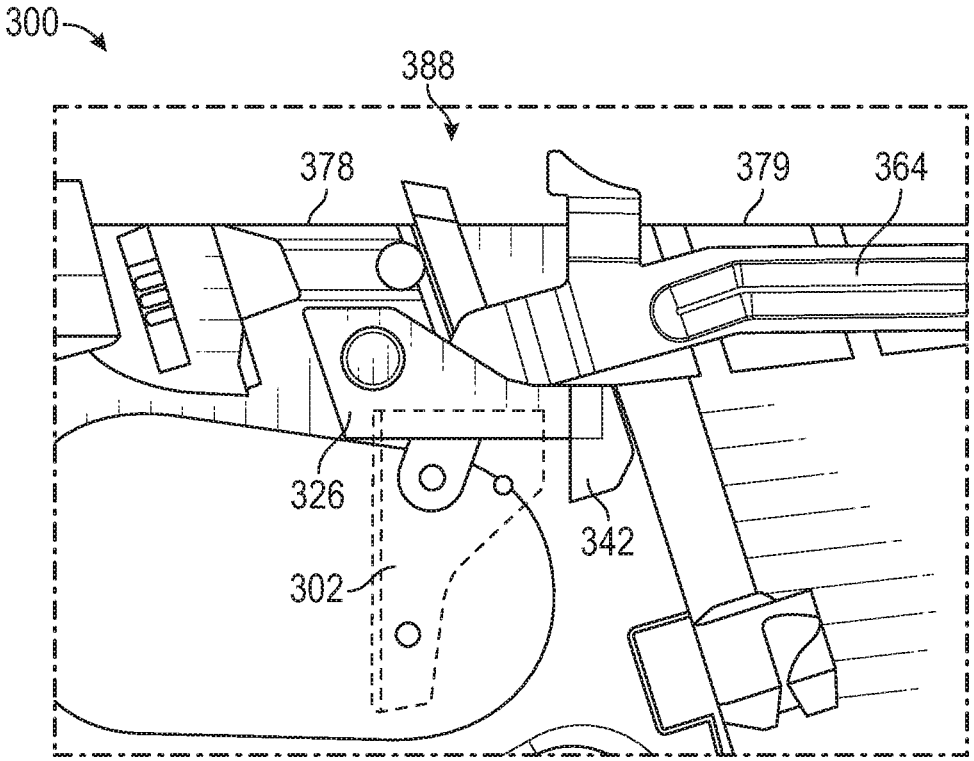
FIG. 10A is a cross-sectional elevation view of a trigger assembly within a firearm grip in a battery position in accordance with one example embodiment of the disclosure.
Figure 10B:
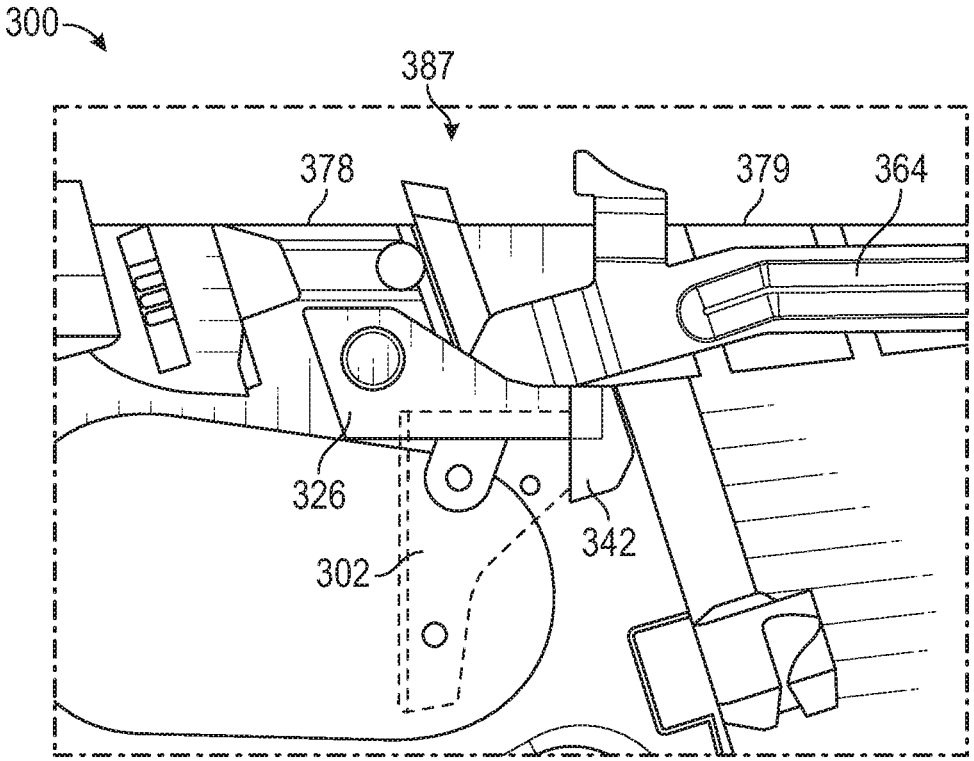
FIG. 10B is a cross-sectional elevation view of the trigger assembly of FIG. 10A in a discharged position in accordance with one example embodiment of the disclosure.

FIGS. 10A and 10B are views of a trigger assembly 300 within a firearm grip 378. FIG. 10A depicts the trigger assembly 300 in a battery position 388. FIG. 10B depicts the trigger assembly 300 in a discharged position 387. In some examples, the trigger assembly 300 includes a trigger shoe 302 coupled to a trigger bar 364 and trigger hood 326. As the trigger assembly 300 moves from the battery position 288 to the discharged position 387, the trigger shoe 302 moves in a plane parallel to a top grip side 379 of the grip 378 within a track (not shown) of the trigger hood 326 and the trigger shoe 302. The trigger shoe 302 stops at a trigger shoe stop 342 in the discharged position 387.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A trigger assembly, comprising:
a trigger shoe having a top surface;
a brace coupled to the trigger shoe;
a joint coupled to the brace;
a trigger bar coupled to the brace;
a trigger hood coupled to the top surface of the trigger shoe and the joint; and
a track disposed between the trigger hood and the trigger shoe, wherein the trigger shoe is configured to move along the track, wherein the track comprises:
a first groove disposed along the trigger hood;
a second groove disposed along the trigger shoe; and
a plurality of ball bearings loosely secured between the first groove and the second groove.

2. The trigger assembly of claim 1, wherein the track comprises:
a keyway slot disposed along a bottom surface of the trigger hood; and
a key disposed on the top surface of the trigger shoe engaged with the keyway.

3. The trigger assembly of claim 1, further comprising a trigger shoe stop coupled to the trigger hood.

4. The trigger assembly of claim 1, further comprising:
a trigger lever having a first end and a second end;
a first latch portion disposed on the first end of the trigger lever; and
a second latch portion disposed on the brace, wherein the first latch portion and the second latch portion are configured to move between a safety position and a dischargeable position.

5. The trigger assembly of claim 4, wherein the trigger lever comprises an indent and a spring, wherein the spring extends from within the indent towards the trigger shoe.

6. The trigger assembly of claim 1, further comprising:
a grip comprising a top grip side, an opposing bottom grip side, a muzzle end, and a butt end;
a trigger guard disposed on the opposing bottom grip side; and
a grip trigger slot extending through the top grip side to the opposing bottom grip side.

7. The trigger assembly of claim 6, wherein the grip comprises:
a trigger pin aperture; and
a trigger pin, wherein the trigger pin is configured to anchor the joint and the trigger hood.

8. The trigger assembly of claim 4, wherein the trigger bar comprises:
a body having a front end, a rear end, a first face, and a second face;
a plunger safety tab coupled to the body;
a cruciform coupled to the rear end of the body; and
a lateral extending leg extending from front end of the body, wherein the lateral extending leg comprises a leg aperture.

9. The trigger assembly of claim 8, wherein the cruciform comprises:
a first arm extending from the body;
a second arm extending from the first arm; and
a third arm extending from the first arm towards the front end of the body.

10. The trigger assembly of claim 9, further comprising:
a trigger shoe pin, wherein the leg aperture, the brace, and the trigger bar receive the trigger shoe pin;
a brace pin, wherein the trigger shoe and the brace receive the brace pin; and
a trigger lever pin, wherein the trigger shoe and the trigger lever receive the trigger lever pin.

11. A trigger assembly, comprising:
a trigger shoe;
a trigger hood coupled to the trigger shoe; and
a track disposed between the trigger hood and the trigger shoe, wherein the trigger shoe moves along the track, and wherein the track comprises:
a first groove disposed along the trigger hood;
a second groove disposed along the trigger shoe; and
a plurality of ball bearings loosely secured between the first groove and the second groove.

12. The trigger assembly of claim 11, wherein the track comprises:
a keyway slot disposed along the trigger hood; and
a key disposed on the trigger shoe and configured to engage with the keyway.

13. The trigger assembly of claim 11, further comprising:
a trigger lever having a first end and a second end;
a first latch portion disposed on the first end of the trigger lever; and
a second latch portion disposed on a brace, wherein the first latch portion and the second latch portion are configured to move between a safety position and a dischargeable position.

14. The trigger assembly of claim 13, wherein the trigger lever comprises an indent and a spring, wherein the spring extends from within the indent towards the trigger shoe.

15. The trigger assembly of claim 11, further comprising:

a grip comprising a top grip side, an opposing bottom grip side, a muzzle end, and a butt end;

a trigger guard disposed on the opposing bottom grip side; and a grip trigger slot extending through the top grip side to the opposing bottom grip side.

16. A trigger assembly, comprising:

a trigger shoe having a top surface;

a brace coupled to the trigger shoe;

a joint coupled to the brace;

a trigger bar coupled to the brace;

a trigger hood coupled to the top surface of the trigger shoe and the joint; and a track disposed between the trigger hood and the trigger shoe, wherein the trigger shoe is configured to move along the track, wherein the track comprises:

a keyway slot disposed along a bottom surface of the trigger hood; and a key disposed on the top surface of the trigger shoe engaged with the keyway.

17. A trigger assembly, comprising:

a trigger shoe having a top surface;

a brace coupled to the trigger shoe;

a joint coupled to the brace;

a trigger bar coupled to the brace;

a trigger hood coupled to the top surface of the trigger shoe and the joint;

a track disposed between the trigger hood and the trigger shoe, wherein the trigger shoe is configured to move along the track;

a trigger lever having a first end and a second end;

a first latch portion disposed on the first end of the trigger lever; and a second latch portion disposed on the brace, wherein the first latch portion and the second latch portion are configured to move between a safety position and a dischargeable position.

18. A trigger assembly, comprising:

a trigger shoe having a top surface;

a brace coupled to the trigger shoe;

a joint coupled to the brace;

a trigger bar coupled to the brace;

a trigger hood coupled to the top surface of the trigger shoe and the joint;

a track disposed between the trigger hood and the trigger shoe, wherein the trigger shoe is configured to move along the track;

a grip comprising a top grip side, an opposing bottom grip side, a muzzle end, and a butt end;

a trigger guard disposed on the opposing bottom grip side; and a grip trigger slot extending through the top grip side to the opposing bottom grip side.

* * * * *